US006511172B2

(12) United States Patent
Tanno et al.

(10) Patent No.: US 6,511,172 B2
(45) Date of Patent: Jan. 28, 2003

(54) PRINTING APPARATUS

(75) Inventors: Koichi Tanno, Kawasaki (JP); Haruhiko Koto, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,500

(22) Filed: Sep. 7, 2001

(65) Prior Publication Data

US 2002/0009319 A1 Jan. 24, 2002

Related U.S. Application Data

(62) Division of application No. 09/193,859, filed on Nov. 18, 1998, now Pat. No. 6,309,064.

(30) Foreign Application Priority Data

Nov. 20, 1997 (JP) ..... 9-319357
Nov. 20, 1997 (JP) ..... 9-319988
Nov. 4, 1998 (JP) ..... 10-312889

(51) Int. Cl.[7] ..... B41J 2/01

(52) U.S. Cl. ..... 347/104; 346/134; 271/193; 271/275; 198/691

(58) Field of Search ..... 347/55, 101, 104, 347/105, 8, 87, 56, 57, 23, 215, 216, 217, 218, 219, 220, 264, 43, 47; 346/134; 271/193, 275; 198/691

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 4,864,461 A | * | 9/1989 | Kasahara | 271/193 |
| 5,245,364 A | * | 9/1993 | Uchida et al. | 347/104 |
| 5,270,738 A | * | 12/1993 | Takahashi et al. | 347/104 |
| 5,369,424 A | | 11/1994 | Hori et al. | 346/134 |
| 5,444,973 A | | 8/1995 | Hattori et al. | 347/87 |
| 5,531,436 A | | 7/1996 | Ohyama et al. | 347/104 |
| 5,646,653 A | | 7/1997 | Fujoka et al. | 347/8 |
| 5,708,463 A | * | 1/1998 | Hirabayashi et al. | 347/143 |
| 5,821,968 A | | 10/1998 | Ohyama et al. | 347/104 |

(List continued on next page.)

FOREIGN PATENT DOCUMENTS

| | | |
|---|---|---|
| AT | 384 780 | 6/1987 |
| JP | 54-56847 | 5/1979 |
| JP | 59-123670 | 7/1984 |
| JP | 59-138461 | 8/1984 |
| JP | 60-71260 | 4/1985 |
| JP | 5-31888 | 2/1993 |
| JP | 5-185661 | 7/1993 |
| JP | 7-53081 | 2/1995 |
| JP | 7-125358 | 5/1995 |
| JP | 7-133035 | 5/1995 |
| JP | 8-112950 | 5/1996 |
| JP | 9-254460 | 9/1997 |

OTHER PUBLICATIONS

J.T. Loiselle et al., "Paper Transport Device", IBM Technical Disclosure Bulletin, vol. 24, No. 5, Oct. 1981, pp. 2290–2292.

*Primary Examiner*—Eugene H. Eickholt
(74) *Attorney, Agent, or Firm*—Fitzpatrick, Cella, Harper & Scinto

(57) ABSTRACT

A printing apparatus includes transporting belt transporting a printing sheet in a flat surface region opposing to respective ejection openings of printing heads, suction force generating means for generating an electrostatic suction force on a transporting surface of the belt and control means for controlling to generate the suction force only in a region opposing to the head. The control means applies positive and negative high potential to the suction force generating means with reference to a potential of the head.

39 Claims, 23 Drawing Sheets

U.S. PATENT DOCUMENTS 5,838,354 A 11/1998 Yamada et al. ..... 347/104
5,896,154 A 4/1999 Mitani et al. ..... 347/102
5,943,081 A * 8/1999 Uchida et al. ..... 34/104
6,022,104 A * 2/2000 Lin ..... 347/43
6,079,815 A * 6/2000 Cook et al. ..... 347/55
6,137,506 A * 10/2000 Sueoka ..... 347/47
6,163,327 A * 12/2000 Mort et al. ..... 347/115
6,196,654 B1 * 3/2001 Uchida et al. ..... 347/23
6,309,064 B1 * 10/2001 Tanno et al. ..... 347/104
6,323,955 B1 * 11/2001 Kanai et al. ..... 347/264

* cited by examiner

RELATED BACKGROUND ART

*RELATED BACKGROUND ART*

RELATED BACKGROUND ART

RELATED BACKGROUND ART

RELATED BACKGROUND ART

VIIIB - VIIIB

PRINTING APPARATUS

This application is a division of application Ser. No. 09/193,859, filed Nov. 18, 1998, now allowed Pat. No. 6,309,064.

This application is based on Patent Application Nos. 319357/1997 filed on Nov. 20, 1997 in Japan, 319988/1997 filed on Nov. 20, 1997 in Japan, and 312889/1998 filed on Nov. 4, 1998 in Japan, the content of which is incorporated hereinto by reference.

BACKGROUND OF THE INVENTION

1. Field of the Invention

The present invention relates generally to a printing apparatus performing printing of an image by ejecting a printing liquid, such as an ink or the like. More particularly, the invention relates to a suction mechanism for a printing medium at a position where the image is printed using a printing head.

2. Description of the Related Art

In general, an ink-jet printing apparatus is adapted to perform printing by ejecting an ink from a printing head toward a printing medium. The ink-jet printing apparatus is advantageous for easiness of down-sizing of the printing head, capability of printing of high definition image at high speed, low running cost, low noise for non-impact type printing system, easiness of printing of a color image using a plurality of colors of inks. Amongst, a full-line type printing apparatus which employs a line type printing head arranged with a large number of ejection openings in a width direction of a printing sheet, can further speed up printing.

However, in a full-line type color printing apparatus a plurality of line type printing heads provided for respective kinds of inks are aligned in a feeding direction of the printing sheet. In such case, a distance from the printing head located at the most upstream side and the printing head located at the most downstream side becomes significantly long. Therefore, once floating of the printing sheet is caused in the printing region, disturbance can be caused in a printed image. Also, floating of the printing sheet can be a cause of jamming or the like. Therefore, it becomes necessary to downwardly forward bias the printing sheet in order to avoid floating.

As means for biasing the printing sheet, there is a method for sucking the printing sheet utilizing electrostatic force, such as those disclosed in Japanese Patent Application Laid-open No. 133035/1995, Japanese Patent Application Laid-open No. 53081/1995 and Japanese Patent Application Laid-open No. 254460/1997. In such ink-jet printing apparatus, an electrostatic suction plate constituted of a conductive electrode is provided in a platen in the printing region to generate the electrostatic force applying a charge. The printing sheet fed from a feeding apparatus by the electrostatic force is sucked and held on an upper surface of a transporting belt and transported while printing is performed by using the printing head.

As a background art relating to the present invention, an example of the ink-jet printing apparatus will be explained with reference to the drawings. FIG. 1 is an illustration showing an overall construction of the ink-jet printing apparatus, FIG. 2 is an enlarged partial view showing the ink-jet printing apparatus shown in FIG. 1 as viewed from the above, and FIGS. 3A and 3B are enlarged view of the major part in the ink-jet printing apparatus shown in FIGS. 1 and 2.

In an image printing apparatus 70 illustrated in FIG. 1, printing sheets P as a printing medium are stacked in a feeding portion 71 and are fed one-by-one from the uppermost one by a feeding roller 72. The printing sheet P thus fed is guided to a lower transporting guide 73 and is pinched between a transporting belt 74 and a pinching roller 75. The transporting belt 74 is driven by a driving roller 77 which is, in turn, driven by a not shown driving source, such as a pulse motor or the like, to transport the printing sheet P to a print start position on a platen 76.

The transporting belt 74 is stretched by the driving roller 77, a driven roller 78 and a pressure roller 79. On the other hand, in the platen, a suction force generating means 80 is fixedly mounted by adhering and is located below the transporting belt 74. It should be noted that the pressure roller 79 is rotatably mounted on one end of an arm which is pivotably mounted on the platen at the other end. The arm 83 is biased by means of a coil spring 84 for applying tension force for the transporting belt 74.

The printing head 85 is a full-line type having a plurality of printing elements arranged in alignment in a transporting direction over an entire width of the printing region of the printing sheet P. The printing heads of respective colors are arranged in sequential order 85K (black), 85C (cyan), 85M (magenta) and 85Y (yellow) from the upstream side of the transporting direction of the printing sheet P, with a given interval, and are mounted on a head holder 85*a*.

As shown in FIG. 2, assuming that an occupied region below the printing head 85 is S1, the suction force generating means 80 arranged below the transporting belt 74 has a size S covering the occupied region S1. As shown in FIG. 3A, the suction force generating means 80 is constituted one set of electrode plate 81 and a grounding plate 82 which are made of conductive metals. These electrode plate 81 and the grounding plate 82 are formed into comb-shape and are of the shapes mutually complement with each other, in which recessed portions of one are penetrated by projecting portions of the other. In a power supply portion 81*a* of the electrode plate 81, a positive or a negative voltage is applied, and a power supply portion 82*a* of the grounding plate 82 is connected to the ground.

As shown in FIG. 3B, in the suction force generating means 80, the electrode plate 81 and the grounding plate 82 are sandwiched by a base layer 80*a* and a surface layer 80*b* for protection. The transporting belt 72 is placed on the upper side of the surface layer 80*b*. The base layer 80*a* and the surface layer 80*b* are formed of synthetic resin, such as polyethylene, polycarbonate and the like.

In the construction set forth above, the printing sheet P is sucked on the upper surface of the transporting belt 74 by the suction force generating means 80 and is transported by the transporting belt 74 with printing by the printing head 85.

The printing sheet P, on which the image is printed, is sandwiched and transported by a discharge roller 86 and a wheel 87 contacted under pressure to be discharged and held on a discharged paper receptacle tray 88. The ejection roller 86 is driven by a rotational force of the driving roller 77 by not shown transmission means. On the other hand, in order to transfer a printing surface, the wheel 87 is in a shape with cone shaped tip ends so as to minimize transfer of the ink of the printed image.

On the other hand, as other construction, with similar construction as the suction force generating means provided in the platen 76, the electrode plate 81 and the grounding plate 82 are integrally provided with the transporting belt for applying a positive or negative voltage from one of side edges in the width direction of the transporting belt 74 and connecting the other side edge to the ground to form the transporting belt per se as the suction force generating means.

However, in the ink-jet printing apparatus as set forth above, the apparatus having the platen, in which the suction force generating means 80 having one set of comb-shaped electrode plate 81 and the grounding plate 82, has a region to be sucked in a size S covering the occupied region S1 of the printing head 85. Therefore, the driving motor is required a large torque in order to drive the transporting belt 74. Thus, greater motor is required. Therefore, power consumption becomes large to cause high cost in the apparatus.

On the other hand, the apparatus, in which the suction force generating means 80 is provided integrally with the transporting belt 74 per se, inherently generate a suction force over a region outside of the printing region of the transporting belt 74 immediately below the printing head 85. Therefore, the printing sheet P can subject the suction force from the transporting belt 74 even in a separating portion from the transporting belt 74 to the ejection roller 86, to make it difficult to certainly separate at the separating portion.

As set forth, since the foregoing printing apparatus generates the suction force even in the extra portion beyond that portion requiring the suction force, an unnecessarily large power can be consumed. Therefore, an improvement is desired in viewpoint of energy efficiency. Furthermore, in general, in a comb-shape electrode, when a power supply period to the electrode becomes long, the base layer 80*a* and the surface layer 80*b* of the electrode portion (particularly a corner portion 80*c* of the electrode) protecting the electrode may deteriorate to cause pin hole to possibly shorten a lifetime of suction force generating means. Thus, improvement of durability of the suction force generating means is desired.

On the other hand, when ink ejection is performed from the printing head using the suction force generating means, an ink droplet 148 ejected from the printing head 85 can be influenced by an electric field of the head 85 and the surface of the printing sheet P and thus charged. Especially, the ink droplet ejected from adjacent nozzles can repulse with each other to cause offset in depositing position from the predetermined depositing position to possibly cause degradation of the printing quality.

SUMMARY OF THE INVENTION

Therefore, an object of the present invention is to provide a printing apparatus which is small in energy loss and achieve high efficiency in providing a mechanism for generating a suction force at a necessary portion and at a necessary timing.

Another object of the present invention is to provide a printing apparatus which is small in power consumption and low in cost with requiring smaller torque for means driving a transporting means.

A further object of the present invention is to provide a printing apparatus which can reduce deterioration of the electrode portion generating the suction force and is thus superior in durability.

According to one aspect of the present invention, there is a printing apparatus performing printing using a liquid ejection head ejecting a printing liquid comprising transporting means for transporting a printing medium in a region opposing to ejection opening of the liquid ejection head, suction force generating means for generating a suction force on a transporting surface of the transporting means, and suction force generation control means for controlling the suction force generating means for generating the suction force only in a region opposing to the liquid ejection head relating to liquid ejection.

According to another aspect of the present invention, there is a printing apparatus comprising a printing head printing an image on a printing medium, a transporting belt transporting the printing medium, suction force generating means constituted by arranging comb shape electrodes integrally formed with the transporting belt and making each individual comb teeth independent, power supply means for supplying a power to a power supplied portion of the electrodes provided on an end portion in the transporting direction of the transporting belt, and depressing means for depressing the printing medium toward the transporting belt at the most upstream side position of a region where a suction force can be generated by the suction force generating means, wherein the power supply means supplies a power to the suction force generating means only in the vicinity of a printing region by the printing head.

According to another aspect of the present invention, there is a printing apparatus comprising a printing head arranged a plurality of printing elements flying coloring material, suction force generating means arranged in opposition to the printing head, positive and negative high potential being applied to the suction force generating means with reference to a potential of the printing head, for sucking a printing medium opposing to the printing head.

The above and other objects, effects, features and advantages of the present invention will become more apparent from the following description of embodiments thereof taken in conjunction with the accompanying drawings.

DESCRIPTION OF THE PREFERRED EMBODIMENT (First Embodiment)

Figure 1:
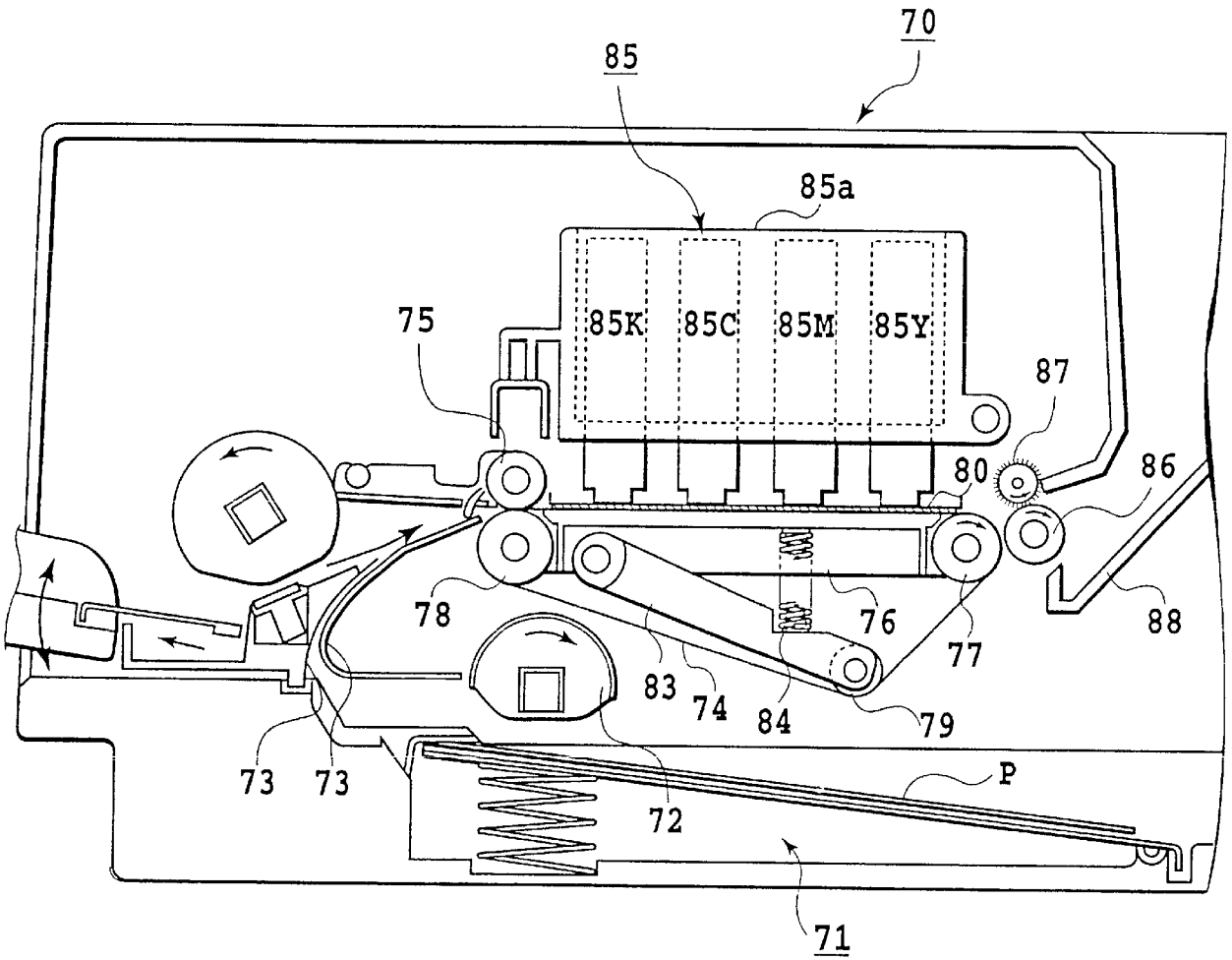
FIG. 1 is a section showing an overall construction of an ink-jet printing apparatus as a background art relevant to the present invention.
Figure 2:
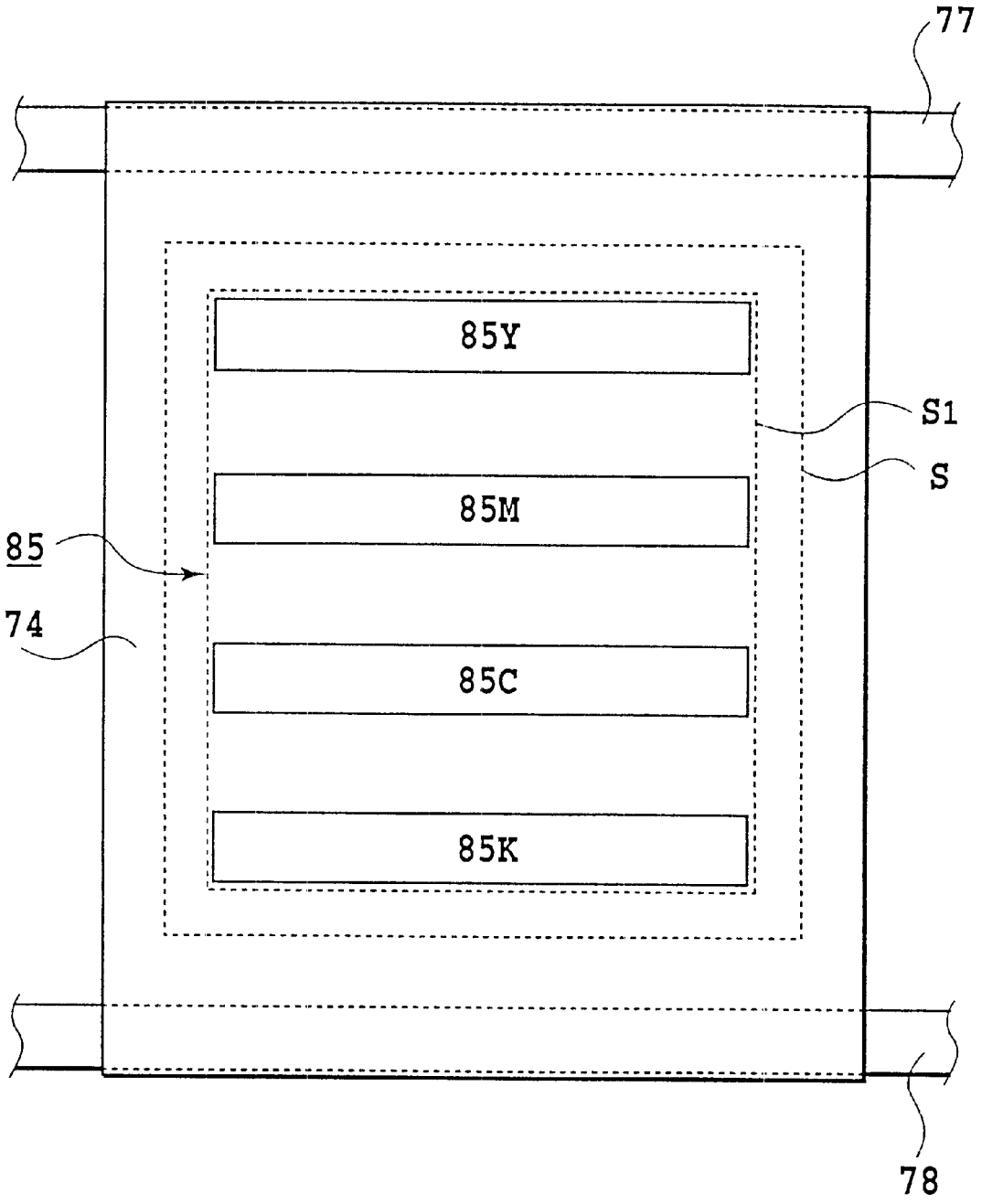
FIG. 2 is an enlarged plan view of the ink-jet printing apparatus shown in FIG. 1, as viewed from the above.
Figure 3A:
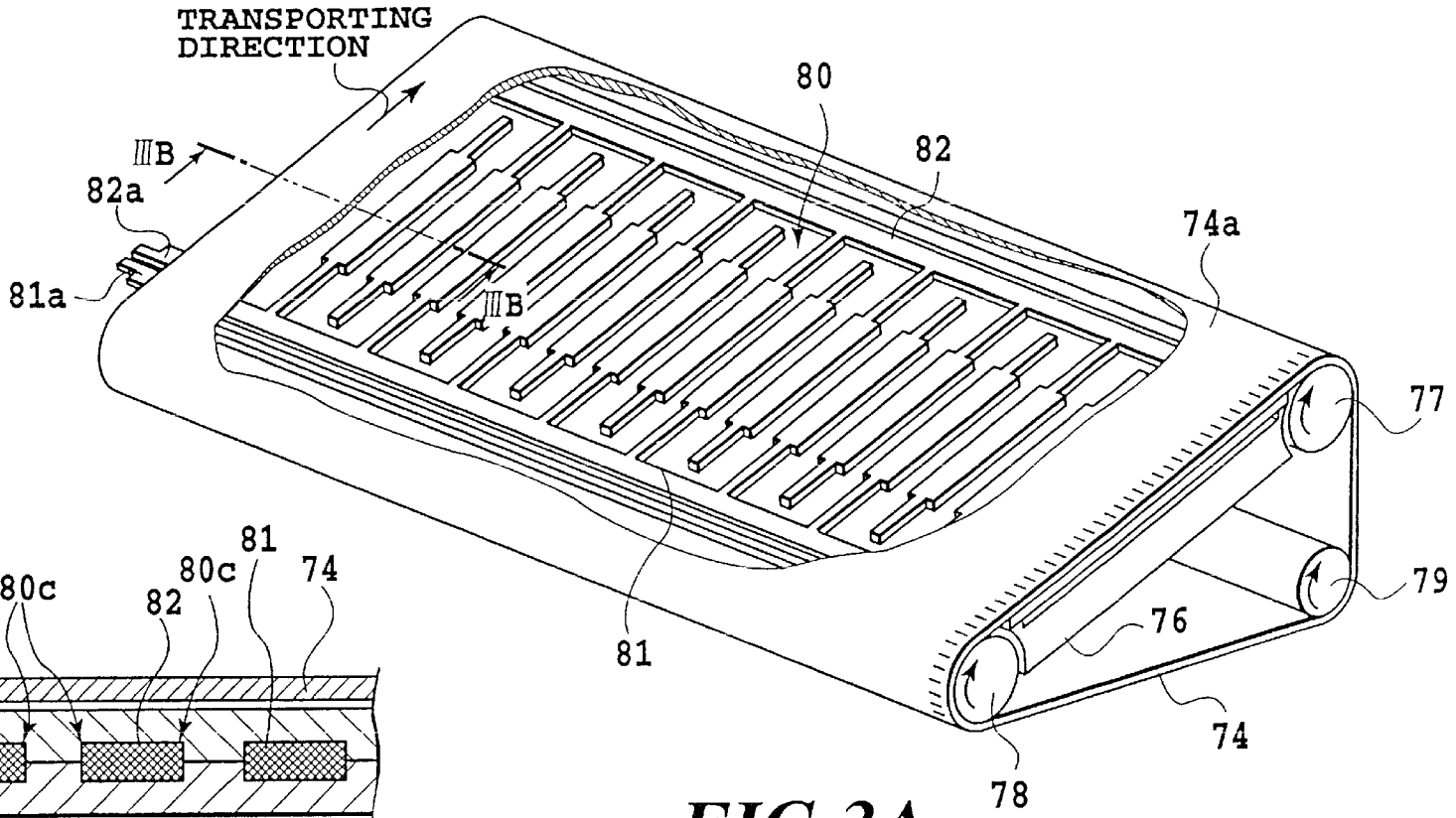
FIG. 3A is an enlarged perspective of the major part of the ink-jet printing apparatus shown in FIGS. 1 and 2.
Figure 3B:
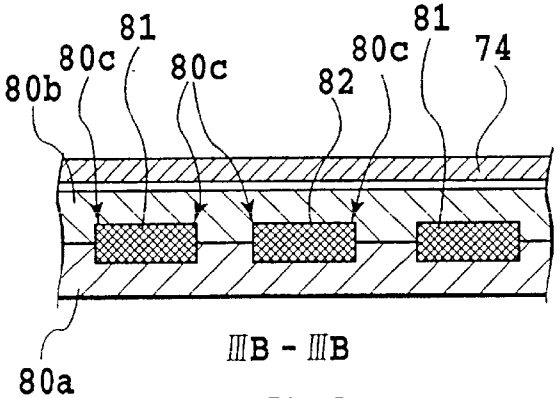
FIG. 3B is a section taken along line a—a of FIG. 3A.
Figure 4:
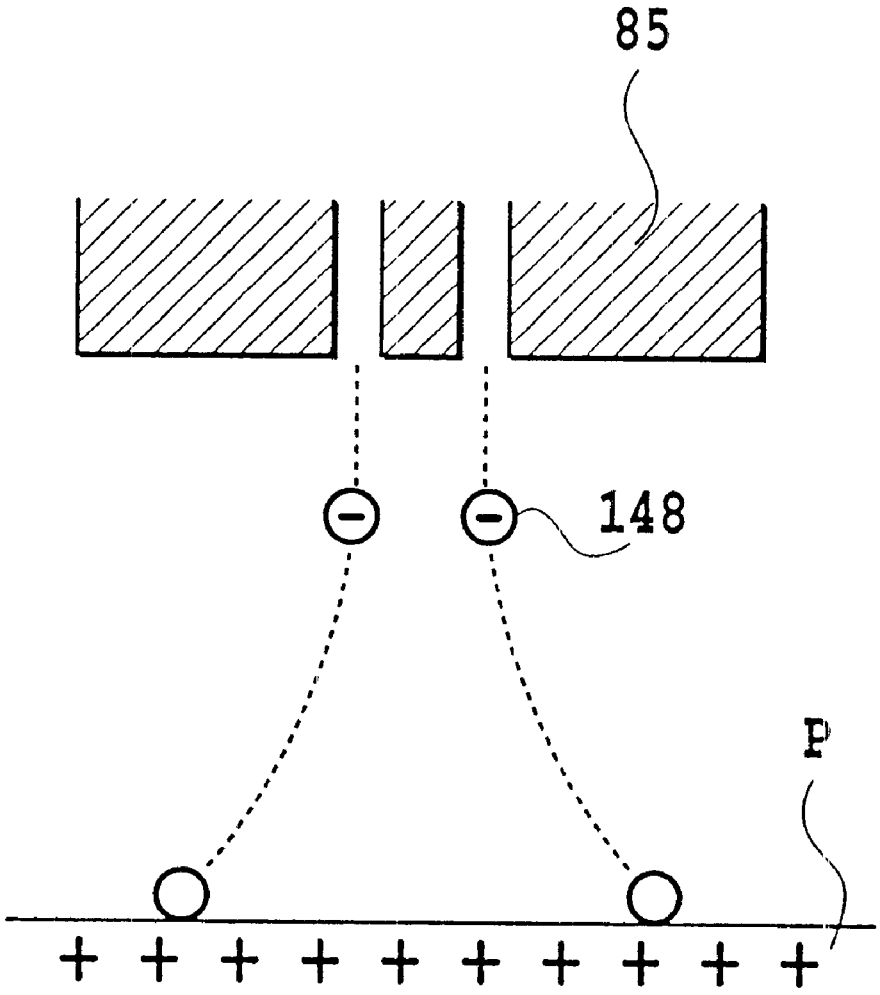
FIG. 4 is a section diagrammatically showing an activity of a charged ink droplet.
Figure 5:
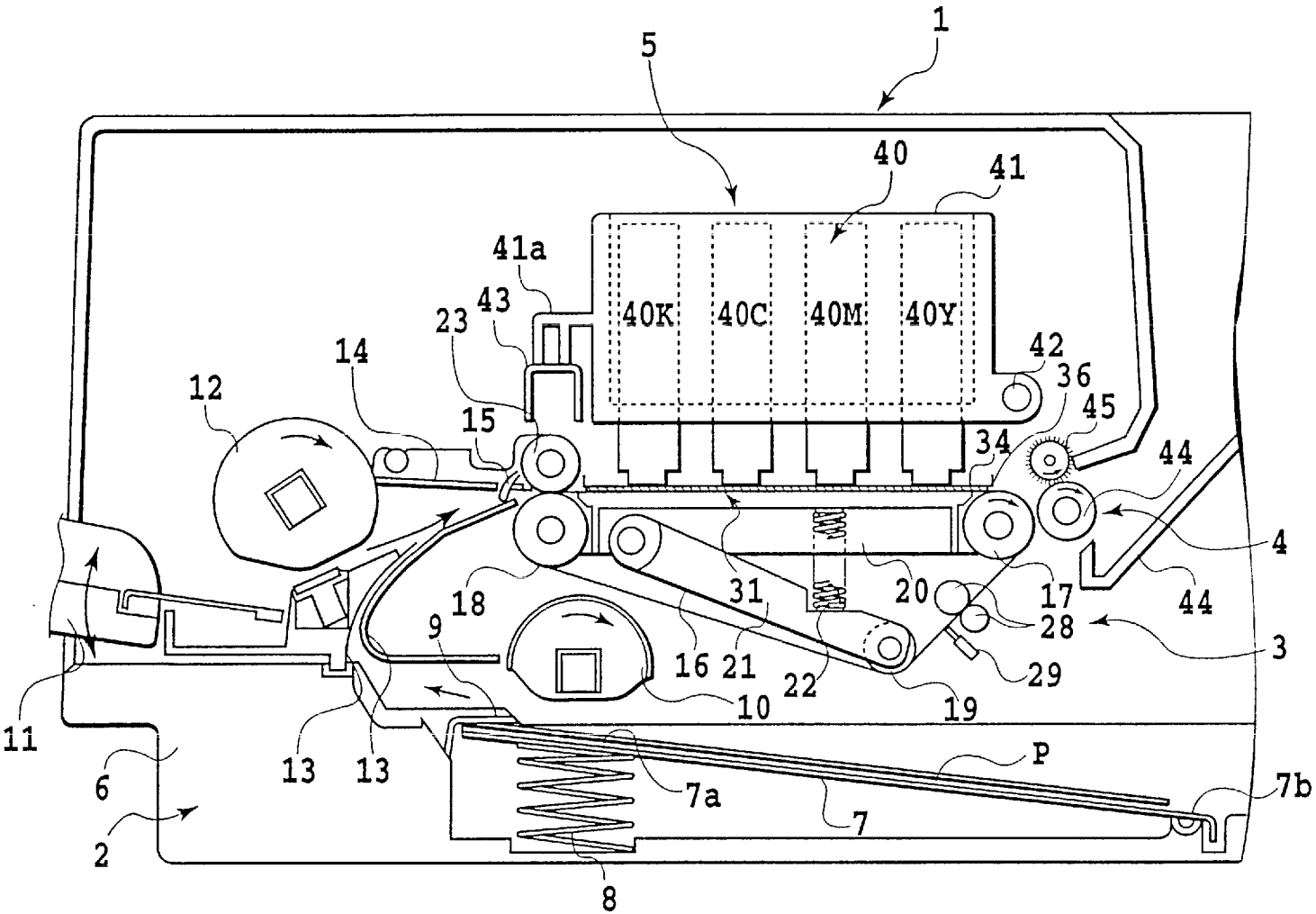
FIG. 5 is a section showing an overall construction of an image printing apparatus as the first embodiment of a printing apparatus according to the present invention.
Figure 6:
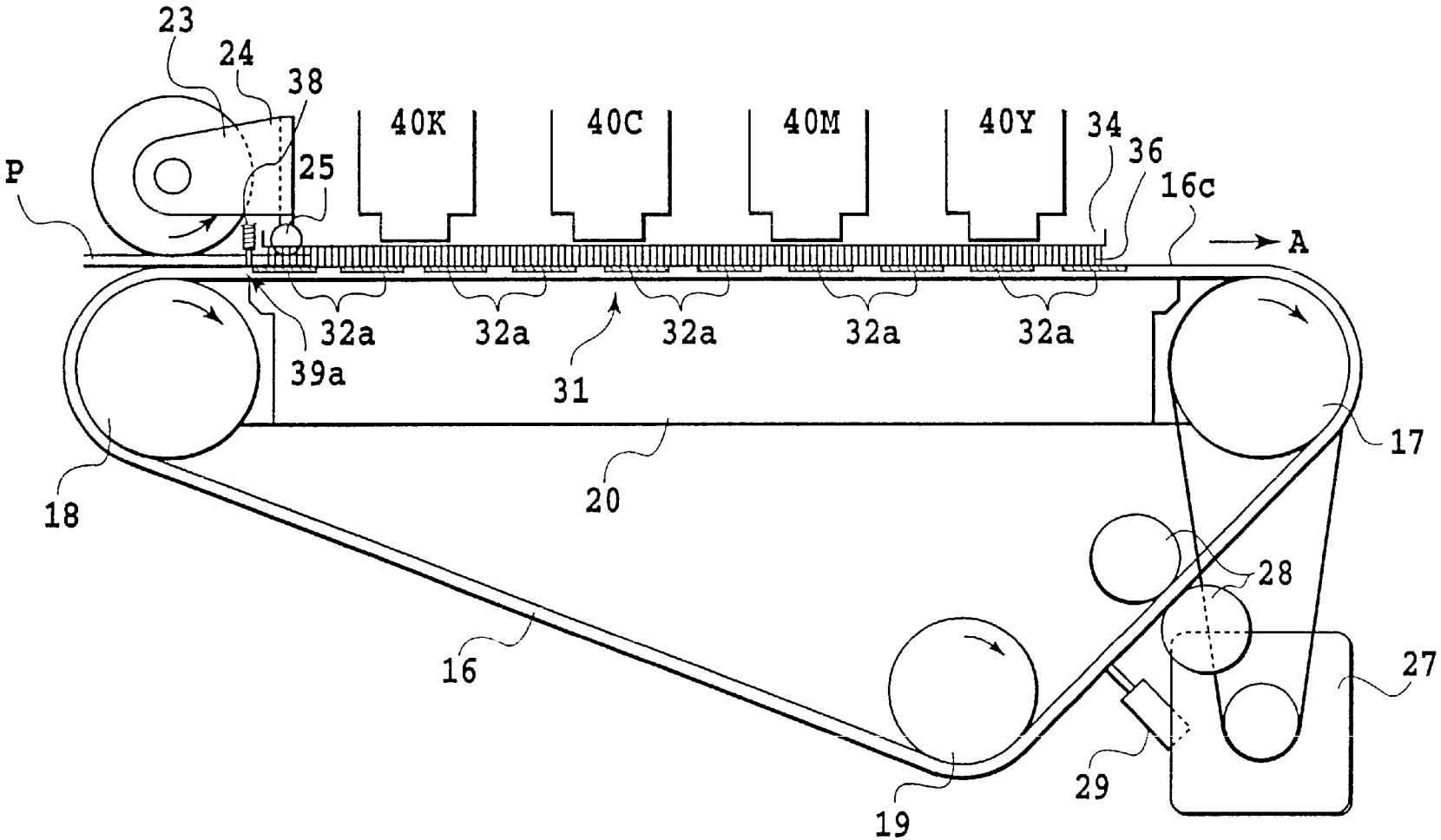
FIG. 6 is a section showing a construction of a feeding portion in the image printing apparatus shown in FIG. 5.
Figure 7:
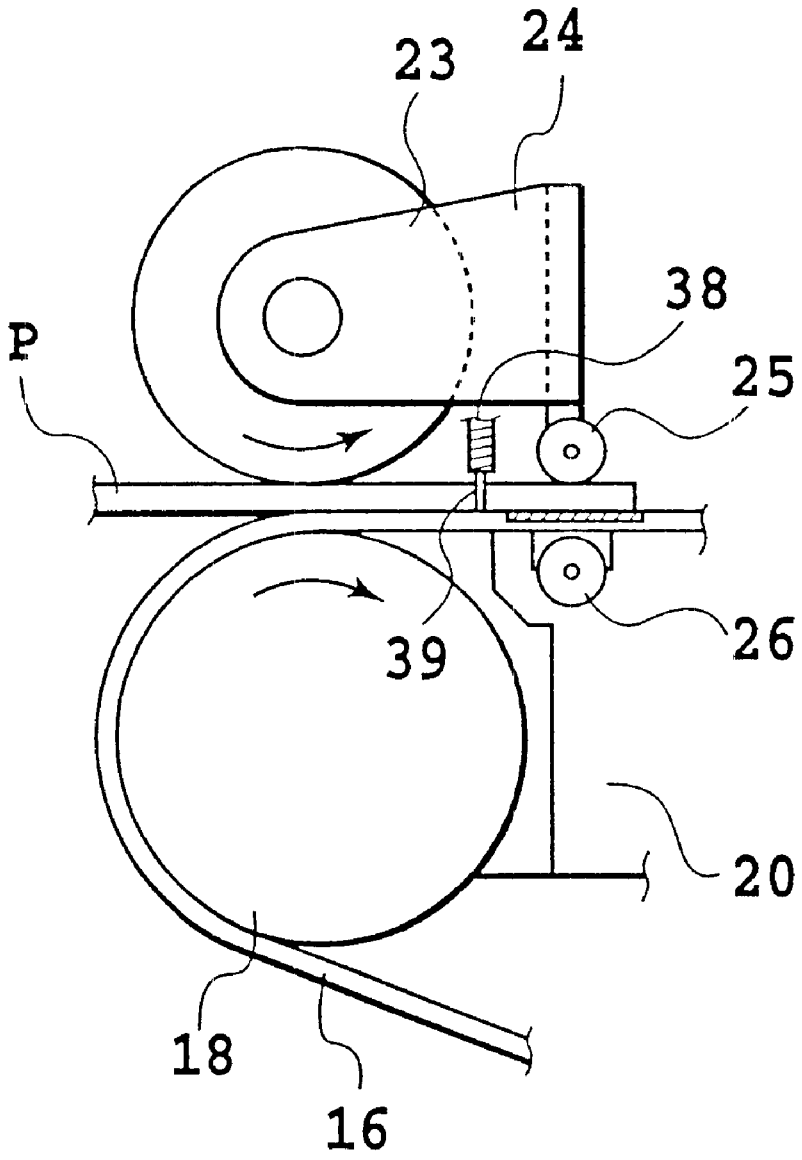
FIG. 7 is an enlarged section in the vicinity of a driven roller of the feeding portion of FIG. 6.
Figure 8A:
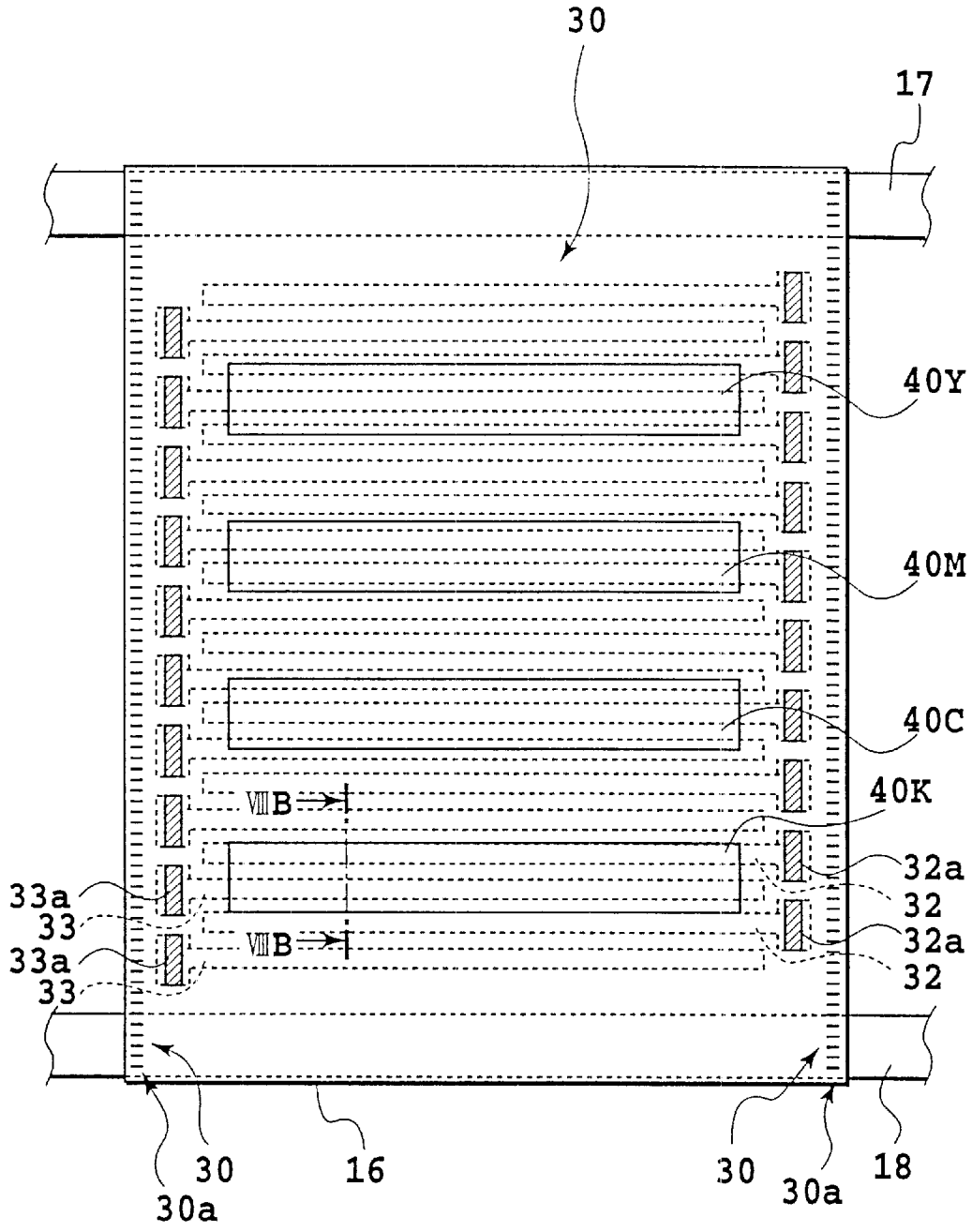
FIG. 8A is a plan view showing a suction force generating means provided in a transporting portion in the image printing apparatus shown in FIG. 5.
Figure 8B:
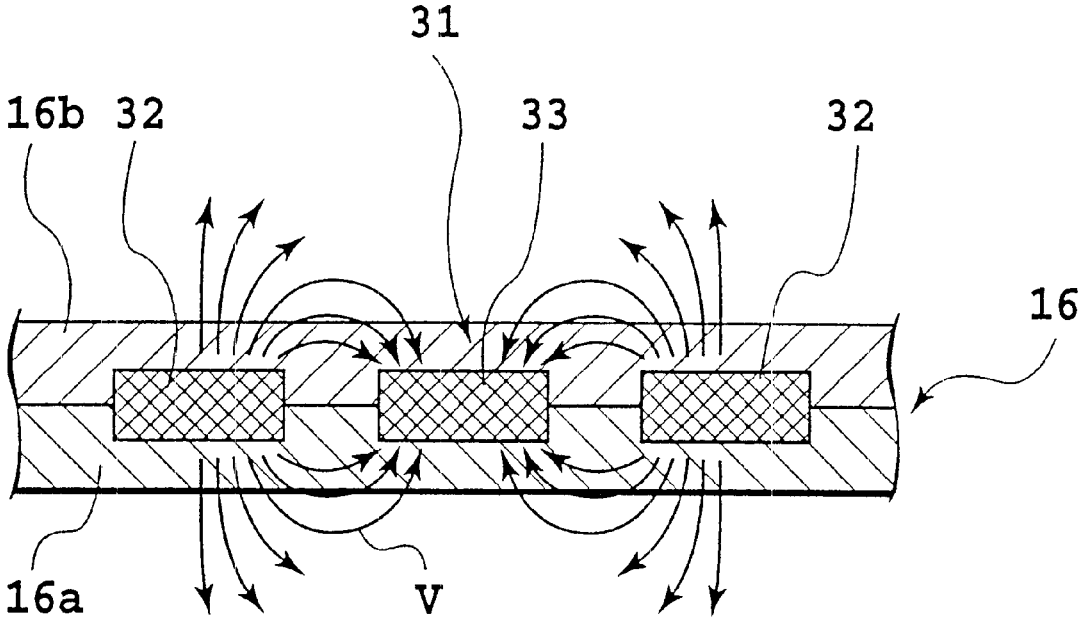
FIG. 8B is a section taken along line a—a of FIG. 8A.
Figure 9:
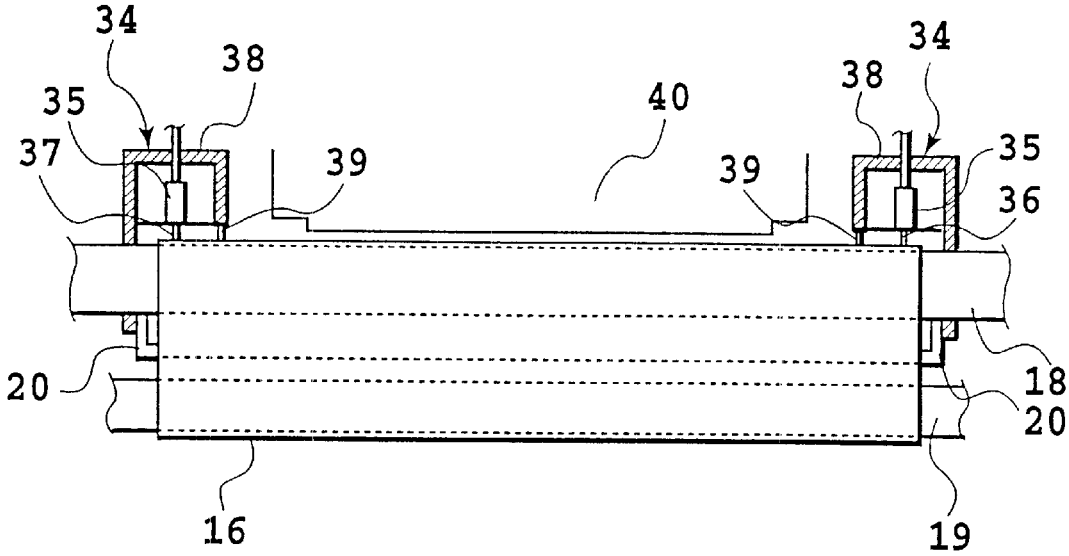
FIG. 9 is a side elevation showing a power supply member in the image printing apparatus shown in FIG. 5.

An embodiment of the printing apparatus according to the present invention will be explained with reference to the drawings. FIG. 5 is a section showing an overall construction of the preferred embodiment of an image printing apparatus, FIG. 6 is a section showing a construction of a feeding portion of an image printing apparatus, FIG. 7 is an enlarged view in the vicinity of a driven roller of the feeding portion, FIG. 8A is a plan view of a suction force generating means provided in a transporting belt, FIG. 8B is a section taken along line a—a of FIG. 8A, and FIG. 9 is a side elevation showing a power supply member performing power supply to the transporting belt.

An image printing apparatus 1 having an automatic feeding apparatus is constructed with (A) feeding portion 2, (B) a transporting portion 3, (C) a printing portion 5 and (D) discharging portion 4. Each of these portions will be explained hereinafter sequentially.

(A) Feeding Portion

The feeding portion 2 is constructed with a pressure plate 7 mounting the printing sheet P and a feeding roller 10 feeding the printing sheet P mounted on a base 6. The pressure plate 7 is pivotable about a rotary shaft 7*b* coupled with the base 6 and is biased toward the feeding roller 10 by means of a pressure plate biasing spring 8. At a portion of the pressure plate 7 opposing the feeding roller 10, a separation pad 7 formed of a material having large friction coefficient, such as an artificial leather or the like, is provided for preventing a plurality of printing sheets from being erroneously fed simultaneously in stacking fashion.

Furthermore, in the base 6, a separation claw 9 for covering a corner portion in one direction of the printing sheet P and separating the printing sheet P in one-by-one basis, and a not shown release cam for releasing contact between the pressure plate 7 and the feeding roller 10, are provided.

In the construction set forth above, in the stand-by state, the release cam depresses the pressure plate 7 to the predetermined position to release contact between the pressure plate 7 and the feeding roller 10. A driving force of a transporting roller 18 is transmitted to the feeding roller 10 and the release cam by a gear or the like, and the release cam is released from the pressure plate 7. Then, the pressure plate 7 is pivoted upwardly to contact the printing sheet P onto the feeding roller 10. The printing sheet P is picked-up associating with rotation of the feeding roller 10 and fed to the transporting portion 3 as being separated one-by-one by the separation claw 9. The feeding roller 10 continues rotation until the printing sheet P is fed to the transporting portion 3. Then, contact between the printing sheet P and the feeding roller 10 is released to be in the stand-by state to cut off the driving force from the feeding roller 18.

On the other hand, on the side portion of the printing apparatus, a manual feeding tray 11 is provided. The printing sheet P stacked on the manual feeding tray 11 is fed by the supply roller 12 for manual feeding rotating according to a printing command signal of a computer or the like, and fed to the transporting portion 3 as guided by a lower guide 13 and an upper guide 14.

(B) Transporting Portion

The transporting portion 3 has a transporting belt 16 transporting the printing sheet P with sucking the same and a not shown sheet end sensor. The transporting belt 16 is wrapped around the driving roller 17, the transporting roller 18 and a pressure roller 19. To the driving roller, a driving force of a driving motor 27 which will be explained later, is transmitted. By this, the transporting belt 16 is driven to circulate in endless manner.

The driving roller 17 and the transporting roller 18 is rotatably mounted on the platen 20. One end of the pressure roller 19 is rotatably mounted on one end the arm 21 which is pivotably mounted on the platen 20 at the other end. A tension force is applied to the transporting belt by depressing the arm 21 by means of the spring 22. On the other hand, the platen 20 is located lower side of the transporting belt 16 and serves for supporting the transporting belt 16.

At a position opposing to the transporting roller 18, a pinching roller 23 is provided. The pinching roller 23 contacts with the transporting belt 16 to be driven to rotate. The pinching roller 23 is contacted with the transporting belt 16 under pressure by a not shown spring for feeding the printing sheet P to the printing portion. On the other hand, on the upper guide 14, over which the printing sheet P is guided from the feeding portion 2, a sensor lever 15 detecting a tip end and rear end of the printing sheet P and feeding a detection signal to the foregoing sheet end sensor.

Also, on the downstream side in the printing sheet transporting direction of the transporting roller 18, a printing head 40 of the printing portion 5 forming an image on the basis of the image information, is provided.

In the construction set forth above, the printing sheet P fed to the transporting portion 3 from the feeding portion 2 as guided by the lower guide 13 and the upper guide 14, is transported to a nip of the transporting roller 18 and the pinching roller 23. At this time, the tip end of the printing sheet P thus transported is detected by the sensor lever 15 to derive a printing position of the printing sheet P.

(C) Printing Portion

The shown embodiment of the printing portion 5 employs a full-line type ink-jet printing head 40, in which a plurality of nozzles are aligned in a direction perpendicular to the transporting direction of the printing sheet P. The printing heads 40 are arranged with a given interval in sequential order of 40K (black), 40C (cyan), 40M (magenta) and 40Y (yellow) from the upstream side of the transporting direction, and are mounted on a head holder 41. The printing heads 40 are constructed for applying a heat for the inks by heater or the like to cause film boiling in the ink by the head. By a pressure variation due to growth and shrinking of the bubble by the film boiling, the inks are ejected from the nozzles of the printing head 40 to form the image on the printing sheet P.

The head holder 41 is pivotably fixed at one end by a shaft 42. A projecting portion 41*a* provided at the other end of the head holder 41 is engaged with a rail 43. By this, a distance (paper gap) between the nozzle surface of the printing a printing surface of head 40 and the printing sheet P can be defined.

(D) Discharging Portion

The discharging portion 4 is constructed with a discharge roller 44 and a wheel 45. The printing sheet P formed with the image in the printing portion is sandwiched and transported by the discharge roller 44 and the wheel 45 to be discharged by a discharged paper receptacle tray 46.

Next, a construction, operation for sucking and transporting the printing sheet in the printing portion, and a construction of the suction force generating means will be explained with reference to FIGS. 5 to 9. At first, the construction for sucking and transporting will be explained with reference to FIGS. 5 to 7.

The transporting belt 16 is formed with a synthetic resin, such as polyethylene, polycarbonate or the like, in a thickness of 0.1 to 0.2 mm. The transporting belt 16 is formed into an endless belt fashion. On the transporting belt 16, the suction force generating means 31 which will be explained later, is provided. By applying a voltage within a range of about 0.5 kV to 10 kV to a power supply member 34 connected to the transporting belt 16, the printing region defined below the printing head 40, a suction force is generated in the transporting belt 16. It should be noted that the power supply member 34 is connected to a not shown high voltage power source generating a predetermined high voltage.

As set forth above, the transporting belt 16 is supported by the driving roller 17, the transporting roller 18, the pressure roller 19 with an appropriate tension. The driving roller 17 is connected to the driving roller 27. On the other hand, as a depression means depressing the printing sheet P toward the transporting belt side, a sheet depression roller 25 is rotatably mounted on a supporting member 24. The supporting member 24 is mounted for pivoting about a rotary shaft of the pinching roller 23. By biasing the supporting member 24 toward the transporting belt 16 by the not shown biasing means, the sheet depression roller 25 is contacted onto the transporting belt 16 under pressure.

As shown in FIG. 7, at a position opposing to the sheet depression roller 25, the driven roller 26 driven by the transporting belt 16 is rotatably mounted on the platen 20 to bear a pressure contact force of the sheet depression roller 25. By this, the transporting belt 16 is depressed downwardly to lower wearing and friction force when the lower surface of the transporting belt 16 and the upper surface of the platen 20 are contacted.

On the other hand, as shown in FIG. 6, a cleaning roller pair 28 is provided to oppose across the transporting belt 16. The cleaning roller pair 28 is formed with a porous sponge having small air aperture diameter (preferably in a range of 10 $\mu$m to 30 $\mu$m) in order to absorb the ink in order to remove contaminant, such as ink or the like deposited on the transporting belt 16. The transporting belt 16 is diselectrified by a diselectrifying brush 29 as a diselectrifying means after cleaning by the cleaning roller pair 28.

Next, the suction force generating means 31 will be described with reference to FIGS. 8A, 8B and 9.

As shown in FIG. 8A, within the transporting belt 16, the suction force generating means 31 constituted of the electrode plate 32 and the grounding plate 33 formed with conductive metals, is provided. The electrode plate 32 and the grounding plate 33 are respectively constructed in comb-shaped configuration with independent teeth. As shown in FIG. 8A, the electrode plate 32 and the grounding plate 33 are arranged within the transporting belt 16 in opposition in a direction perpendicular to the transporting direction of the transporting belt.

At both end portions in motion direction of the transporting belt 16, the electrode plate 32 and the grounding plate 33 have portions 32*a* and 33*a* to be supplied the power (portion where a pattern is exposed). The portions 32*a* and 33*a* to be supplied the power will be hereinafter referred to as power supplied portion. The power supplied portions 32*a* and 33*a* have a greater distance than a width of the electrode plate 32 and the grounding plate 33. As shown in FIG. 9, the power supplied portions 32*a* and 33*a* are in contact with conductive power supply brushes 36 and 37 respectively at given pressure. From the power supply brush 36 to the power supplied portion 32*a* of the electrode plate 32, positive or negative voltage is applied by a not shown high voltage power source. The power supply brush 37 connected to the power supplied portion 33*a* of the grounding plate 33 is grounded.

On the other hand, as shown in FIG. 8B, the transporting belt 16 protects the suction force generating means 31 constituted of the electrode plate 32 and the grounding plate 33 formed of the conductive metal, with the base layer 16*a* and the surface layer 16*b*. The base layer 16*a* and the surface layer 16*b* are formed of synthetic resin, such as polyethylene, polycarbonate or the like.

When the electrode plate 32 is applied the voltage, an electric force is generated in a direction shown by arrow to form an electric flux line V as shown in FIG. 8B. By a potential difference between the electrode plate 32 and the grounding plate 33, a suction force is generated at the upper position of the transporting belt, and on the printing surface of the printing sheet P, an electric charge (surface potential) of equal polarity to the voltage applied to the electrode plate 32 is generated. At this time, since the electric force generated at the electrode plate 32 is not always reach the grounding plate 33, the suction force generated on the electrode plate 32 becomes stronger than that generated on the grounding plate 33.

The printing sheet P transported from the feeding portion 2 is synchronized with the transporting belt by a not shown control means with a sheet end sensor detecting the tip end position of the printing sheet P and by reading an encoder which is provided on the transporting belt and will be explained later, a not shown transporting belt position detecting sensor. By depressing the tip end of the printing sheet P onto the transporting belt 16 by the sheet depression roller 25 at a position above the electrode plate 32, to which the positive or negative voltage is applied, the printing sheet P can be certainly sucked on the transporting belt.

Next, operation of the suction means will be explained. As shown in FIG. 6, the printing sheet P is pinched on the transporting belt 16 by means of a transporting roller 18 and the pinching roller 23, depressed toward the transporting belt by the sheet depression roller 25, sucked onto a plain surface portion 16*c* of the transporting belt 16 as being sucked to be introduced into the printing portion. Then, the printing sheet P is transported in the direction of arrow A by the driving motor 27 and the driving roller 17 with performing printing by the printing head 40.

As shown in FIG. 9, the power supply brushes 36 and 37 of the power supply member 34 are supported by the supporting member 35, and are connected to the not shown high voltage power source, respectively. On the supporting member 35 and the power supply brushes 36 and 37, a cover 38 and a seal member 39 serving as a protective member surrounding overall periphery are provided for protection. The cover 38 is mounted on the platen 20 at the outer side and the sealing member 39 formed of an elastomer of low hardness is provided over the entire inner peripheral edge to contact with the transporting belt 16 with a predetermined pressure. Thus, by the cover 38 and the sealing member 39, periphery of the power supply member 34 is isolated from the outside with defining a given gap.

It should be noted that the cover 38 is formed of a material superior in sealing ability for isolating even electrically from the outside. On the other hand, the sealing member 39 may also be formed with porous material capable of absorbing the ink, and more preferable be formed of a material having superior electric shielding ability. On the other hand, for setting the gas between the cover 38 and the transporting belt in a gap amount not influenced for electrical shield, no problem will be arisen even if the sealing member 39 is omitted.

Here, in the most upstream side position 39*a* in the motion direction of the transporting belt 16 (see FIG. 6), the shown embodiment of the sealing member 39 is designed for cleaning the upper surface of the transporting belt 16, particularly the power supplied portions 32*a* and 33*a* and establish good electrical contact between the power supplied portions 32*a* and 33*a* and the power supply brushes 36 and 37. Furthermore, in the shown embodiment, the sealing member 39 is provided on the cover 38 to use as the cleaning means of the transporting belt 16. However, it is also possible to independently provide the cleaning means instead of providing on the cover 38.

As set forth above, in the transportation with suction in the shown embodiment, the end portion of the printing sheet P will never float as being transported by the transporting belt 16. Accordingly, upon printing on the tip and the rear end portions of the printing sheet P, printing can be performed with locating the ejection nozzles at the end portion of the printing head 40 in the vicinity of the end portion of the printing sheet P to obtain the printing image with high precision.

On the other hand, when a large amount of ink is ejected toward the printing sheet P, the printing sheet P may cause expansion to generate cockling. However, by suction force of the suction force generating means 31 and depression force of the sheet depressing roller 25, the printing sheet P is sucked toward the transporting belt 16. Therefore, the printing sheet P may not float on the side of the printing head 40 to permit stable print. On the other hand, even when cockling or curing is caused in the printing sheet P due to variation of environment, such as temperature, humidity and the like, it becomes possible to suck the printing sheet P on the transporting belt 16 in stable condition by depressing the printing sheet P onto the transporting belt 16 by the sheet depression roller 25.

Next, explanation will be given for an encoder 30 in the shown embodiment with reference to FIG. 8A. In FIG. 8A, a mark 30*a* as the encoder 30 is set on the surface of the transporting belt 16 with a predetermined pitch. As the pitch of the mark 30*a*, 1/180, 1/360 and so on can be considered. The marks 30*a* is detected by a not shown sensor arranged above the transporting belt 16. A signal output from the sensor detecting the marks 30*a* is counted by not shown detecting means and integrated. Then, a predetermined value of the count for stopping the printing sheet P at a predetermined position, is preliminarily set. When the counted value reaches the predetermined value, driving of the transporting belt is stopped.

It should be noted that the mark 30*a* may be white color when the transporting belt 16 is black color and the mark 30*a* may be black color when the transporting belt 16 is white color. The material of the mark 30*a* is certainly deposited on the surface of the transporting belt 16, while not specifically limited. On the other hand, the mark 30*a* may be a three-dimensional shape, such as providing of hole or the like, instead of the paint deposited on the surface of the. transporting belt 16.

On the other hand, in the shown embodiment, the power supplied portions 32*a* and 33*a* of the suction force generating means 31 or the power supply member 34 are provided on the upper surface of the transporting belt 16. It is also possible to provide the power supplied portions of the suction force generating means and the power supply member on the lower surface (back surface) of the transporting belt 16. It is also possible to generate the suction force on the upper surface of the transporting belt 16 by applying a charge to the suction force generating means 31 from the lower surface. Similarly, concerning the encoder 30, it is possible to provide the encoder on the lower surface of the transporting belt 16 to read at the lower surface.

Furthermore, in the shown embodiment, the power supply brushes 36 and 37 of the power supply member 34 are provided for covering the entire region of a plurality of printing heads 40. However, it is also possible to provide the power supply brushes 36 and 36 of the power supply member 34 for covering each printing head independently.

(Second Embodiment)

Figure 10:
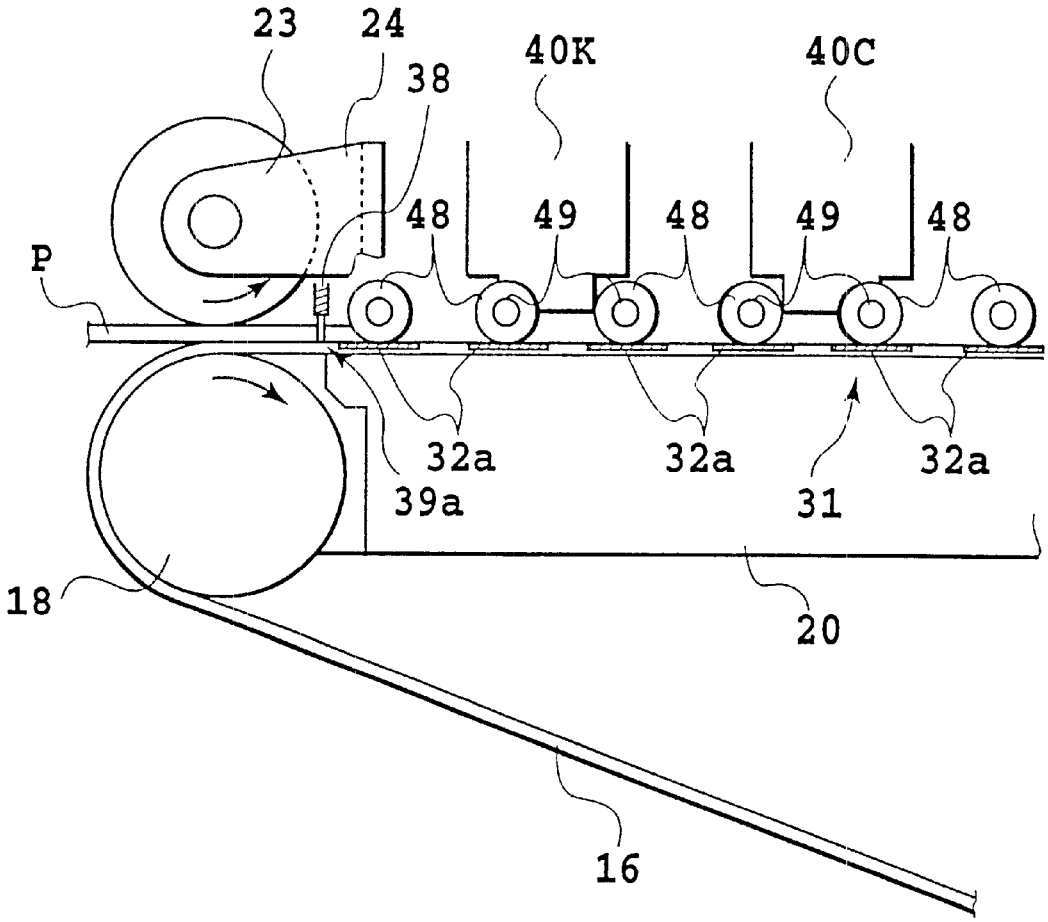
FIG. 10 is a section showing a construction of a transporting portion in the image printing apparatus as the second embodiment of the printing apparatus according to the present invention.
Figure 11:
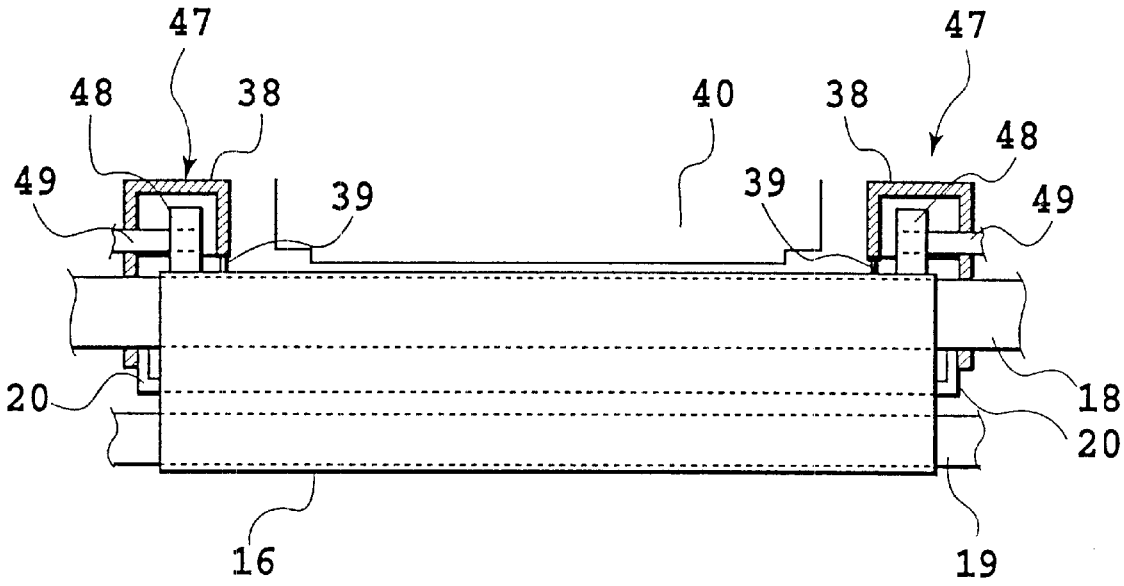
FIG. 11 is a side elevation showing the power supply member in the image printing apparatus shown in FIG. 10.

Next, the second embodiment of the printing apparatus according to the present invention will be explained with reference to FIGS. 10 and 11. It should be noted that like components to those in the foregoing first embodiment will be identified by like reference numerals and detailed description for such common components will be omitted for avoiding redundant description to keep the disclosure simple enough to facilitate clear understanding of the present invention. FIG. 10 is a side elevation showing a construction of the transporting portion of the printing apparatus, and FIG. 11 is a side elevation showing the power source member performing power supply for the transporting belt.

In the power supply member 47 in the shown embodiment, power supply rollers 48 formed of a conductive metal, are rotatably mounted on support shafts 49. On the support shaft 49 formed of the conductive metal similarly to the power supply rollers 48, not shown high voltage power source is connected for applying positive or negative charge to the power supply rollers 48. The power supply rollers 48 are in contact with the power supply portions 32*a* and 33*a* of the suction force generating means 31 to be driven for rotation to supply the power to the electrode plate 32 and the grounding plate 33.

It should be noted that while the shown embodiment employs a contact type power supply system, in which the conductive roller is used for applying charge to the suction force generating means 31, non-contact type using a thin plate, such as SUS having a tip end of acute shape may be used.

(Third Embodiment)

Figure 12:
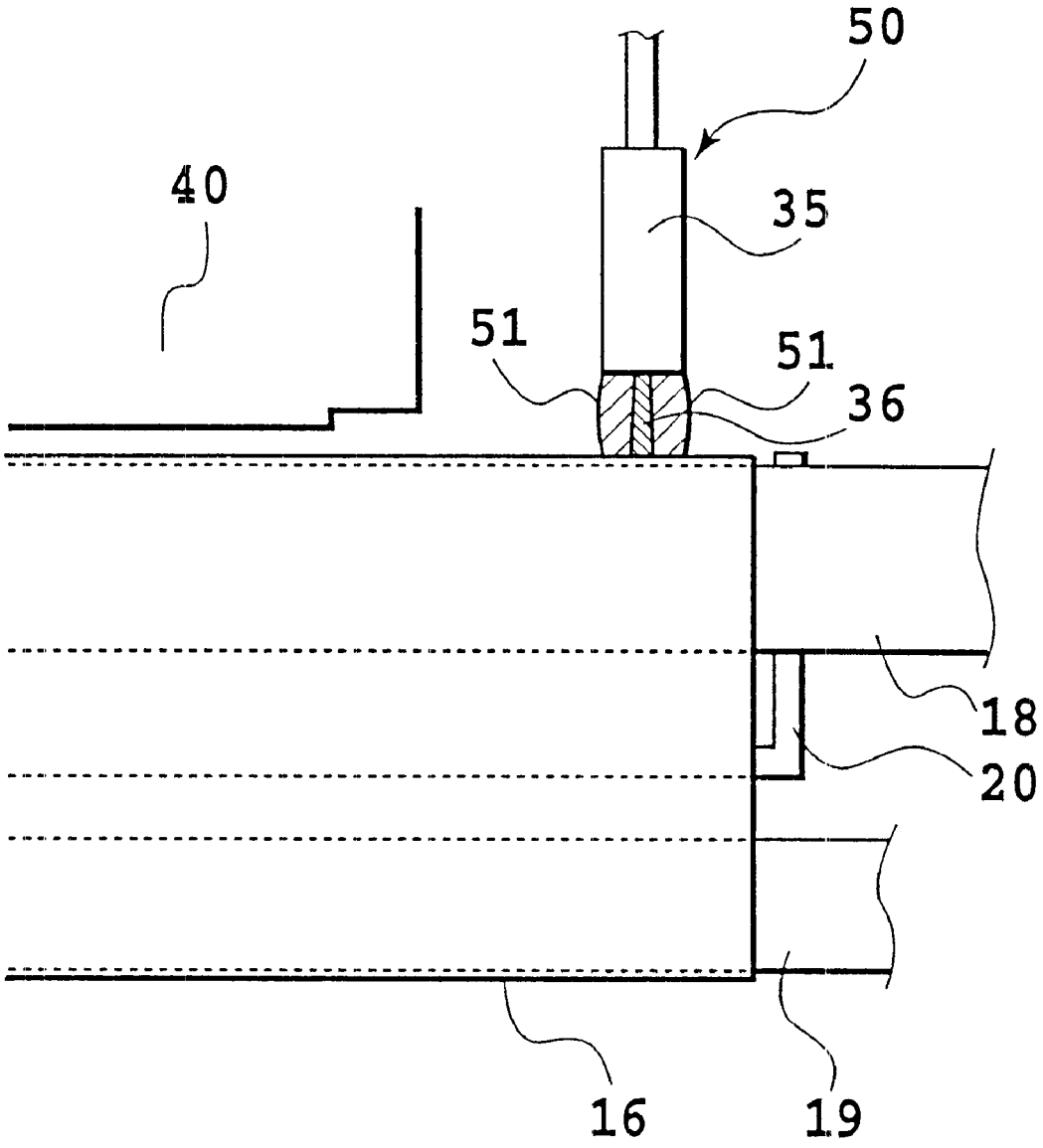
FIG. 12 is a side elevation showing a power supply member in the image printing apparatus as the third embodiment of the printing apparatus according to the present invention.

Next, a construction and operation of the third embodiment of the present invention will be explained with reference to FIG. 12. It should be noted that like components to those in the foregoing first embodiment will be identified by like reference numerals and detailed description for such common components will be omitted for avoiding redundant description to keep the disclosure simple enough to facilitate clear understanding of the present invention. FIG. 12 is a side elevation showing the power supply member performing a power supply for the transporting belt.

In the shown embodiment, in a power supply member 50, the entire periphery of the power supply brush 36 is covered with the insulation brush 51 as a protecting member having electrical insulation ability. Both of the power supply brush 36 and the insulation brush 51 are constructed by mounting on the supporting member 35.

By constructing as set forth above, the cover 38 and the sealing member 39 as employed in the first embodiment becomes unnecessary. Therefore, construction can be simplified.

(Fourth Embodiment)

Figure 13:
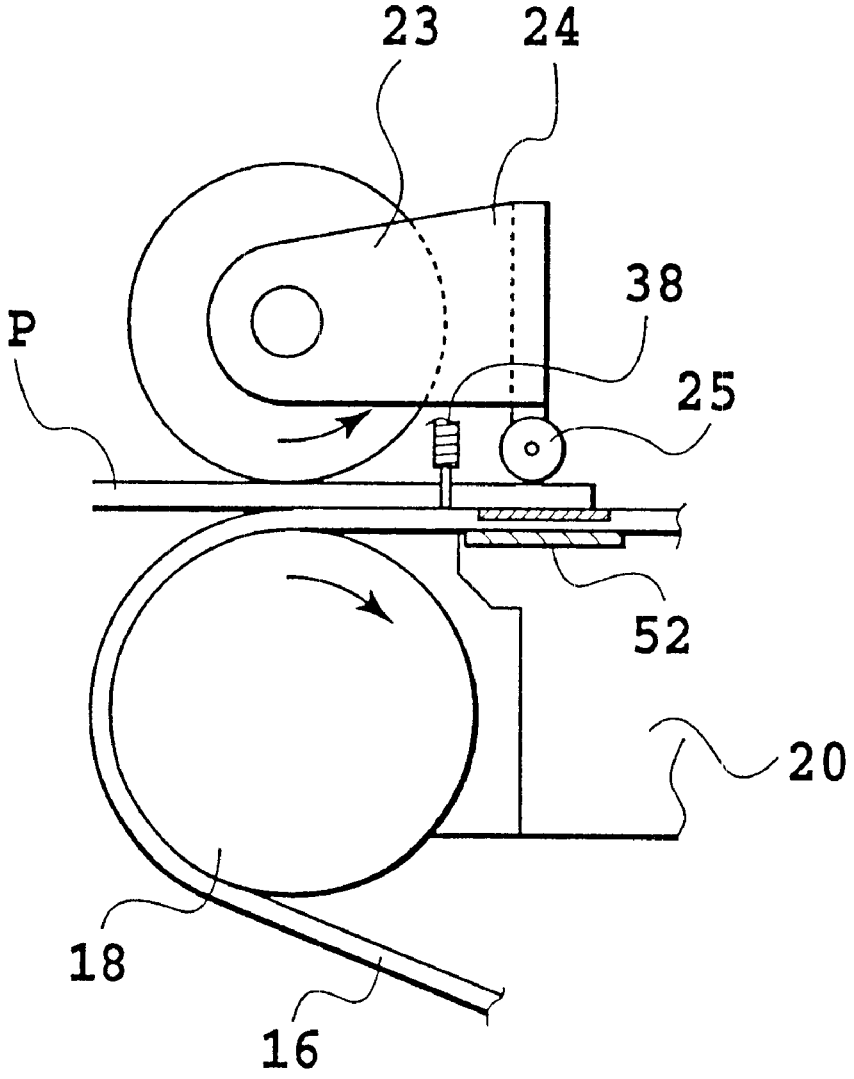
FIG. 13 is an enlarged section of a portion in the vicinity of a driven roller of a power supply portion in the image printing apparatus as the fourth embodiment of the printing apparatus according to the present invention.

As shown in FIG. 13, at a position opposing to the sheet depression roller 25 of the platen 20, a resin sheet 52 formed of a polyacetal resin or a resin or the like provided with a fluorine coating on a surface of the sheet 52, is provided. By this, even when the transporting belt 16 is downwardly depressed by the sheet depression roller 25, wearing or friction force upon contacting the lower surface of the transporting belt 16 and the upper surface of the platen 20 can be reduced.

On the other hand, while the resin sheet 52 is provided at only position opposing to the sheet depression roller 25 of the platen 20, it may be possible to further reduce wearing or friction force by providing the resin sheet 52 on the upper surface of the platen 20.

With the foregoing embodiment, by providing the suction generating means integrally within the transporting belt, the suction force is not applied to the transporting belt and the platen. Accordingly, frictional resistance between the transporting belt and the platen will never be increased to permit driving of the transporting belt with small torque. Therefore, power consumption becomes small to achieve low cost of the apparatus.

On the other hand, by supplying the power to the suction force generating means only in the vicinity of the printing region immediately below the printing head, suction force is not applied to the printing sheet P at the most downstream end of the transporting belt. Accordingly, the printing sheet P can be easily and certainly separated from the transporting belt to be discharged.

Furthermore, since the suction force can be generated only in the printing region, energy loss becomes small to achieve high energy efficiency. Also, since a period for driving the suction force generating means can be reduced, deterioration of the surface layer and the base layer protecting the electrode in the vicinity of the electrode, can be reduced to improve durability of the suction force generating means.

In addition, by providing a friction reducing member is provided at the position opposing to the sheet depression roller across the transporting belt, wearing and friction force upon contacting the lower surface of the transporting belt and the upper surface of the platen can be reduced to improve durability of the apparatus.

On the other hand, with the construction to depress the tip end of the printing sheet toward the transporting belt at the position on the electrode plate applied the positive or negative voltage, by means of the depressing means, the printing sheet can be certainly sucked on the transporting belt.

On the other hand, by providing the cleaning means for cleaning the transporting belt between the driving roller and the pressure roller, and by providing the diselectrifying means for diselectrifying the transporting belt at downstream of the cleaning means, the diselectrifying means may not be contaminated by ink or the paper dust to certainly and stably diselectrify the transporting belt.

On the other hand, since the power supply means applying the voltage to the suction force generating means is insulated from the outside by the protecting member, the power supply means will never be influenced by the paper dust, ink mist or the like to supply the voltage in stable condition.

Furthermore, the construction, in which the protecting member is formed with the insulation brush, the cover or the sealing member becomes unnecessary. Therefore, the construction can be simplified to lower production cost of the apparatus.

On the other hand, by providing the cleaning member for cleaning the power supply portion of the suction force generating means at the most upstream position in the motion direction of the transporting belt, at the power supply portion, it becomes possible to contact with the power supply means without being influenced by contamination of the dust, paper dust, ink and the like. Accordingly, the power can be supplied stably to achieve high reliability of the apparatus.

(Fifth Embodiment)

Next, the construction and operation of the fifth embodiment of the present invention will be explained with reference to FIGS. 14A and 14B. It should be noted that like components to those in the foregoing first embodiment will be identified by like reference numerals and detailed description for such common components will be omitted for avoiding redundant description to keep the disclosure simple enough to facilitate clear understanding of the present invention.

Figure 14A:
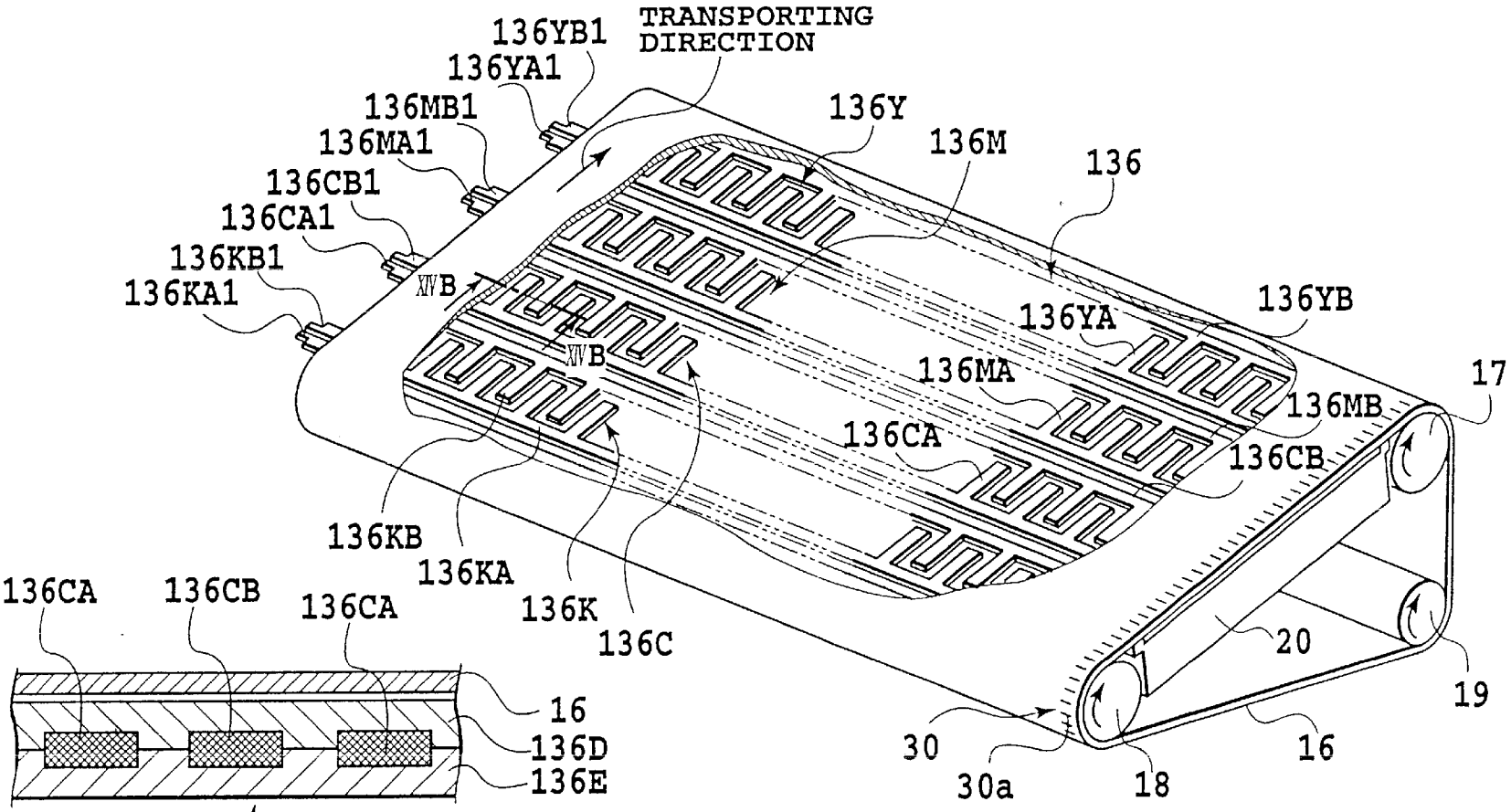
FIG. 14A is a general perspective view showing a construction of a transporting portion and a suction force generating means in the image printing apparatus as the fifth embodiment of the printing apparatus according to the present invention.
Figure 14B:
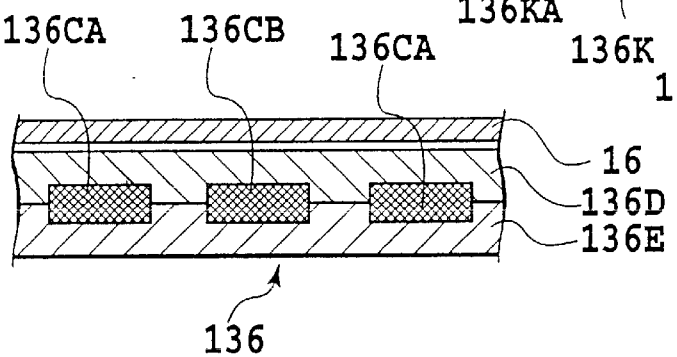
FIG. 14B is a section taken along line a—a of FIG. 14A.

FIG. 14A is a general perspective view showing the construction of the transporting portion and the suction force generating means in the fifth embodiment of the present invention, and FIG. 14B is a section taken along line a—a of FIG. 14A.

In FIGS. 14A and 14B, the reference numeral 136 denotes the suction force generating means. The suction force generating means 136 is arranged on the platen 20 opposing the printing head 40. The feature of the shown embodiment is that mutually independent suction force generating means 136K, 136C, 136M and 136Y are provided at respective positions corresponding to the line type heads 40K, 40C, 40M and 40Y. Each of these suction force generating means includes comb-shaped electrode plate and grounding plate of mutually complementary shape to penetrate projecting portions of one of the plate into recessed portions of the other plate. Further explanation will be given with taking the suction force generating means 136C as an example. Positive or negative voltage is applied to a terminal 136CA1 of an electrode plate 136CA, and a terminal 136CB1 of a grounding plate 136CB is grounded. On the other hand, as shown in FIG. 14B, in the suction force generating means 136C, the electrode plate 136CA and the grounding plate 136CB formed of the conductive metal are protected as being sandwiched between the base layer 136E and the surface layer 136D. On the surface layer 136D, the transporting belt 16 is provided. The base layer 136E and the surface layer 136D are formed of synthetic resin, such as polyethylene, polycarbonate and the like. Similarly to 136C, terminals 136KA1, 136MA1, 136YA1 in the electrode plates 136K, 136M and 136Y are applied positive or negative voltage, and terminals 136KA2, 136MA2 and 136YA2 are grounded.

The suction force generating means 136 is applied a voltage in a range of about 0.5 kV to 10 kV to generate the suction force only in the specific region of the transporting belt 16 as a portion corresponding to the printing head 40, and is connected to the high voltage source (not shown) generating the predetermined high voltage.

(Sixth Embodiment)

The shown embodiment provide solution for the problems in that the ink droplet is influenced by the electric field formed by the suction force generating means generating the suction force used for maintaining flatness of the printing sheet in the first embodiment to cause mutual repulsing between the ink droplets ejected from adjacent nozzles to offset from the predetermined position of deposition. The feature of the printing head is that positive or negative high potential is applied to the suction force generating means with reference to the potential of the printing head.

Figure 15:
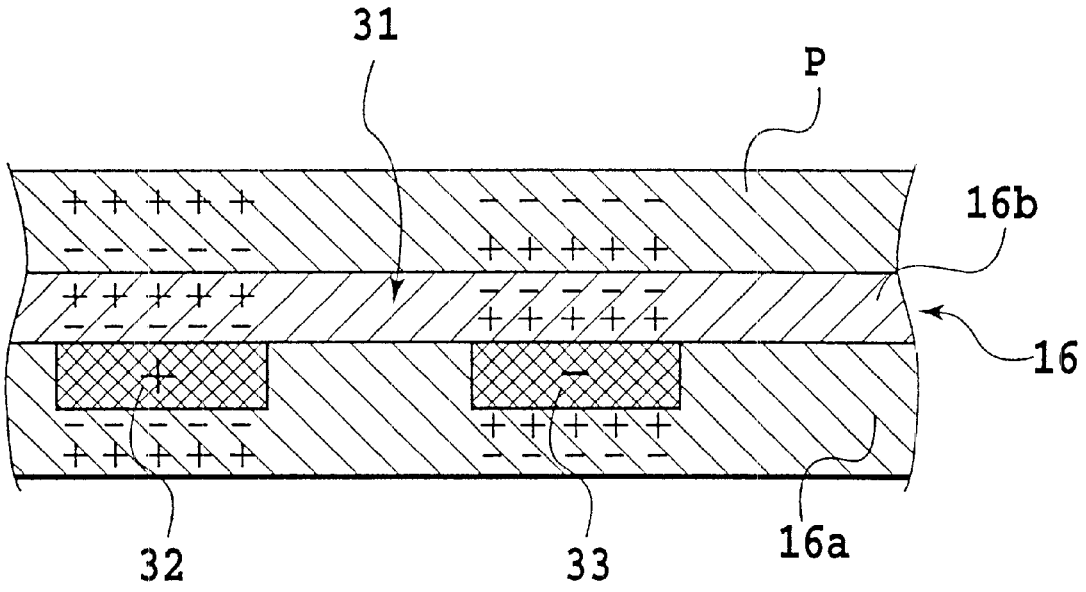
FIG. 15 is a section taken along line b—b of FIG. 8A.
Figure 16:
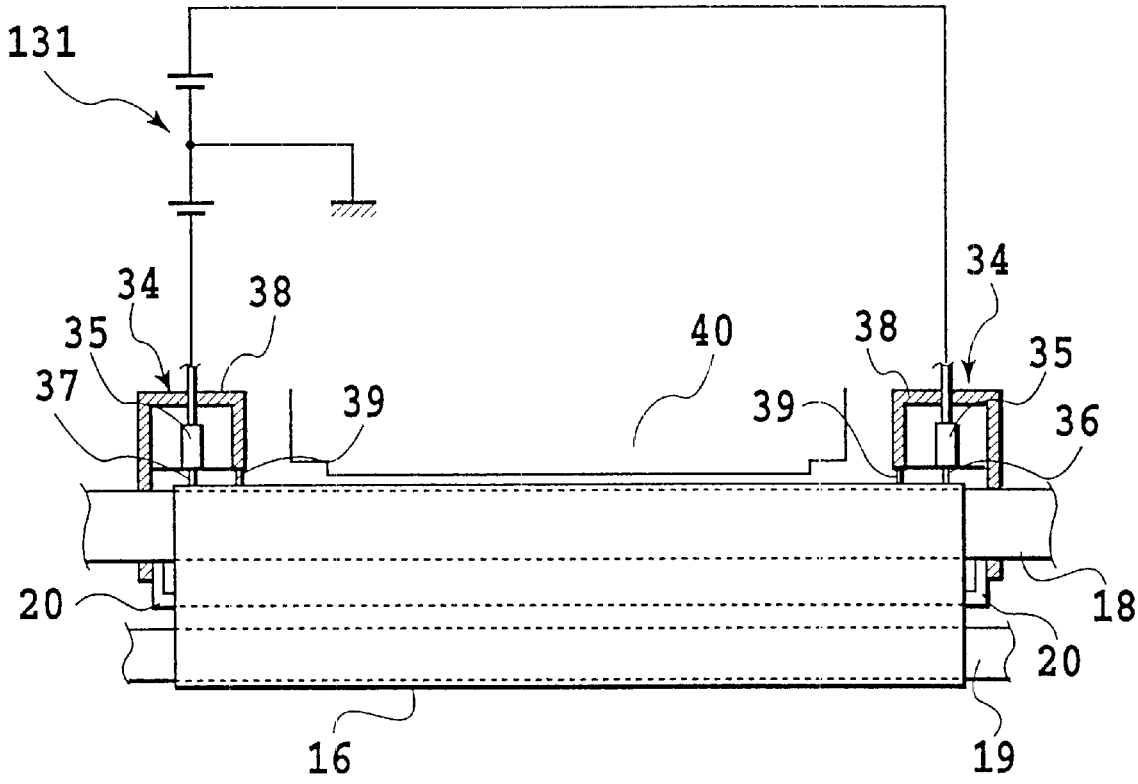
FIG. 16 is a side elevation showing a power supply for a transporting belt.

FIG. 15 is a section taken along line b—b of FIG. 8A referred to in the first embodiment. It should be noted that the electrode plate 33 are used. On the other hand, FIG. 16 is a section indicative of the circuit construction including the shown embodiment of the power supply member.

Namely, in the shown embodiment, the electrode plate 32 and 33 have power supplied portions 32*a* and 33*a* (portion where the patterns are exposed) at both sides in the motion direction of the transporting belt 16. The power supplied portions 32*a* and 33*a* have greater distance the width of the electrode plates 32 and 33. As shown in FIGS. 15 and 16, the conductive brushes 36 and 37 are contacted with the power supplied 32*a* and 33*a* at a given pressure respectively. To the power supply portion 32*a* of the electrode plate 32 from the power supply brush 36, the positive voltage of the grounded high voltage power source 131 is applied. To the power supply brush 37 connected to the power supply portion 33*a* of the electrode plate 33, the negative voltage is applied. Thus, when the voltage is applied to the electrode plates 32 and 33, polarization is caused in the surface layer 16*b* and the printing sheet P as shown in FIG. 15. Thus, the printing sheet P is sucked onto the suction force generating means 21 by electrostatic force.

Figure 17:
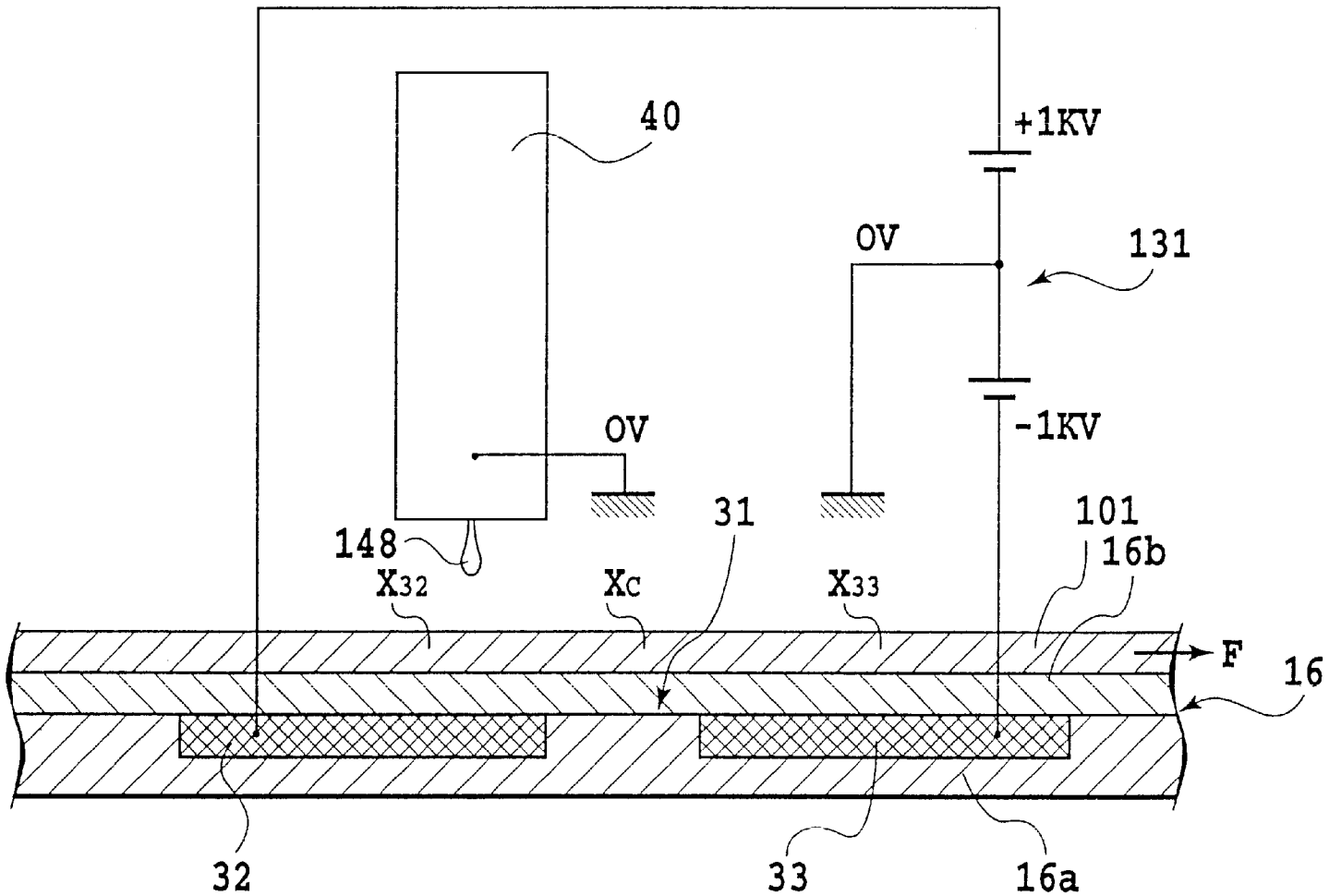
FIG. 17 is a diagrammatic section showing a construction of the embodiment of the present invention.

FIG. 17 shows a condition for sucking the printing sheet P onto the suction force generating means 31 by the shown embodiment. The positive and negative power source 131 is grounded through a grounding terminal. A positive voltage +1 kV is connected to the electrode plate 32 via the power supply brush 36 shown in FIG. 16. A negative voltage −1 kv is connected to the electrode plate 33 via the power supply brush 37 shown in FIG. 16. The printing head 40 is grounded via a grounding terminal 141. The printing sheet P is transported in a direction shown by the arrow F associating with movement of the transporting means 16.

Figure 18:
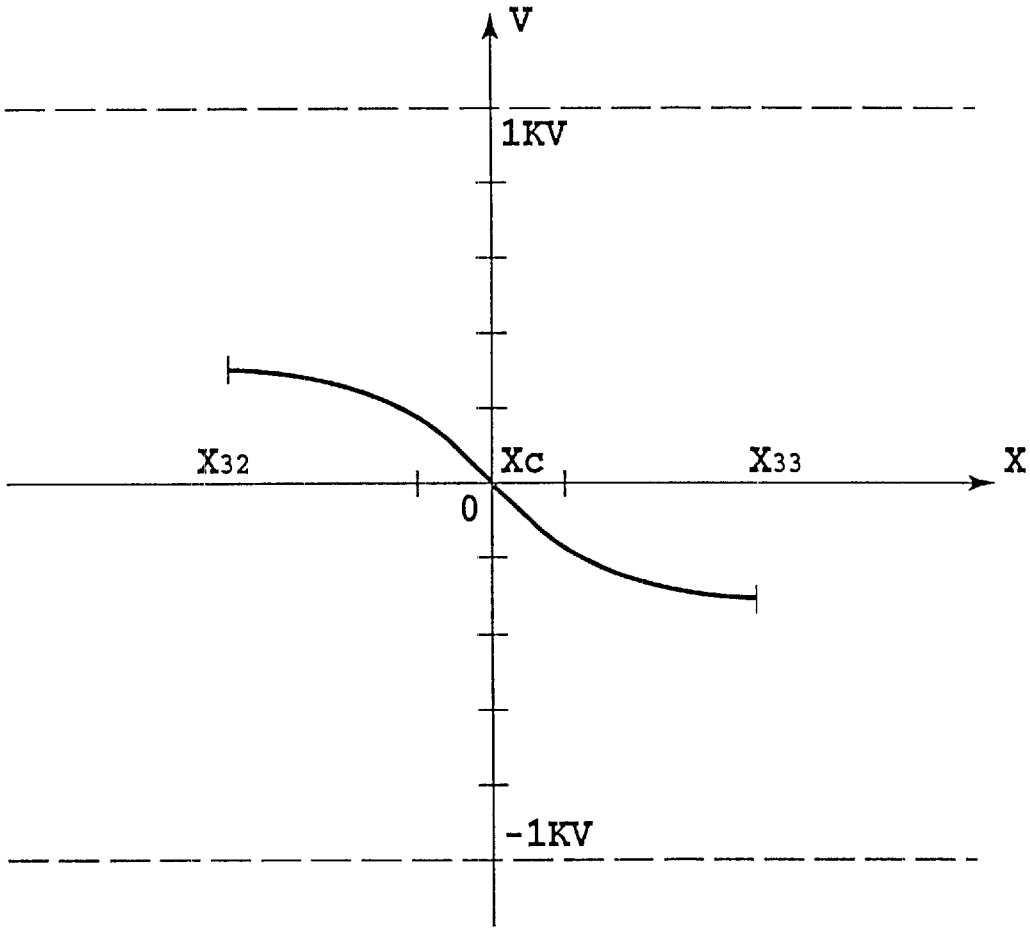
FIG. 18 is a graph showing a surface potential of a printing paper of the embodiment shown in FIG. 17.

FIG. 18 shows actually measured values of the potential on the surface of the printing sheet P. Since the printing sheet P is moved in the direction of arrow F of FIG. 17, the surface potential of the printing sheet P mating with the printing head 40 is varied to be the maximum potential at an intermediate point $X_{32}$ of the electrode plate 32 and the value thereof is about 0.3 kV. On the other hand, at the center point Xc between the electrodes 32 and 33, the voltage becomes substantially 0V, and at the intermediate point $X_{33}$ of the electrode plate 33, the voltage becomes about −0.3 kV. These voltage values are variable depending upon the dimension of the suction force generating means 31, thickness and material of the base layer 16*a* or the surface layer 16*b*, material or, further the humidity.

Figure 19:
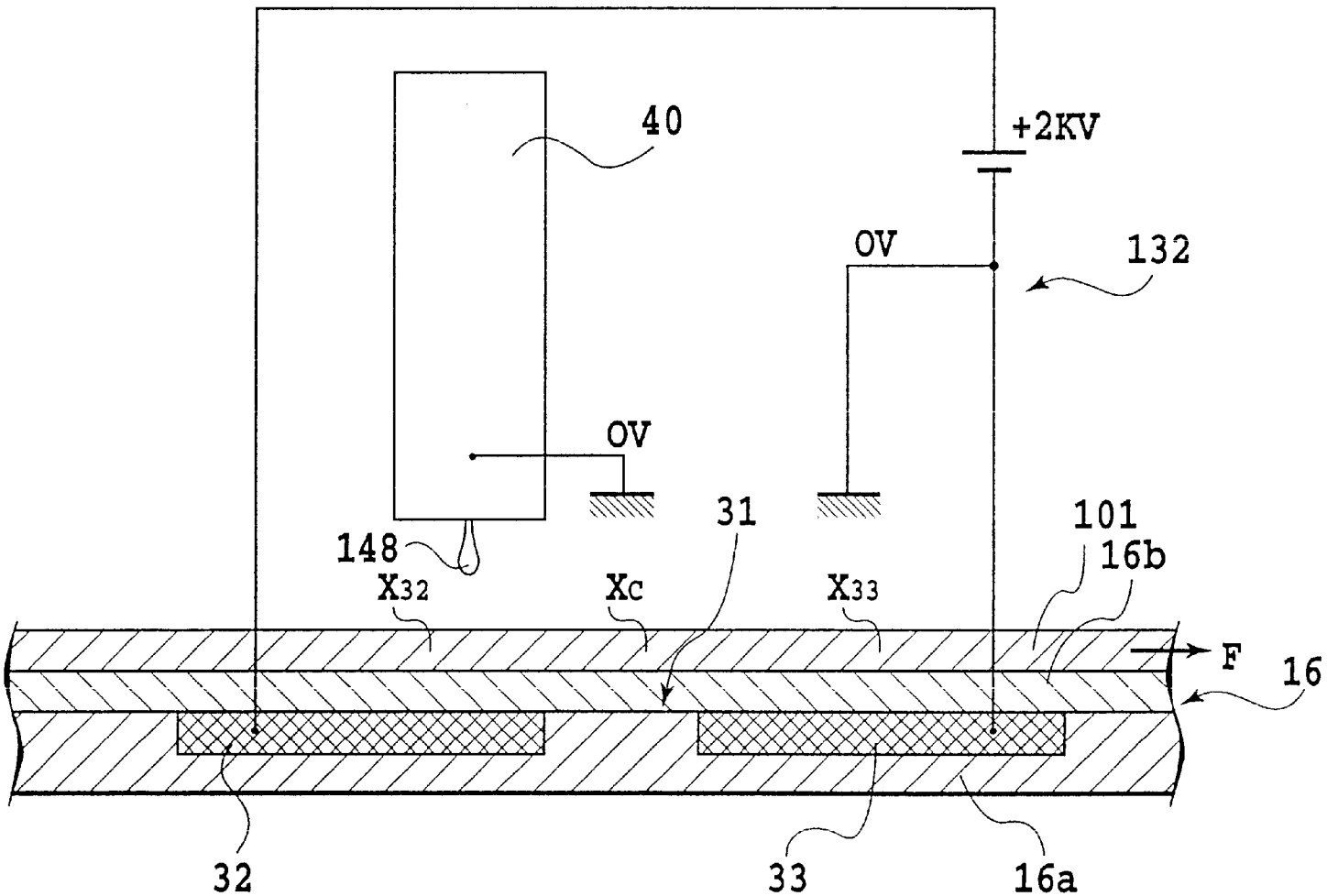
FIG. 19 is a diagrammatic section showing a construction of a comparative example.

FIG. 19 shows a condition where the printing sheet is sucked by the suction force generating means as constructed in the conventional method, as comparative example. Different from the present invention shown in FIG. 17, 0V of the power source 132 is connected to the electrode plate 33 and +2 kV is connected to the electrode plate 32. Between the electrode plates 32 and 33, the voltage of 2 kV is applied. Accordingly, the suction force is the same as that of the embodiment shown in FIG. 17.

Figure 20:
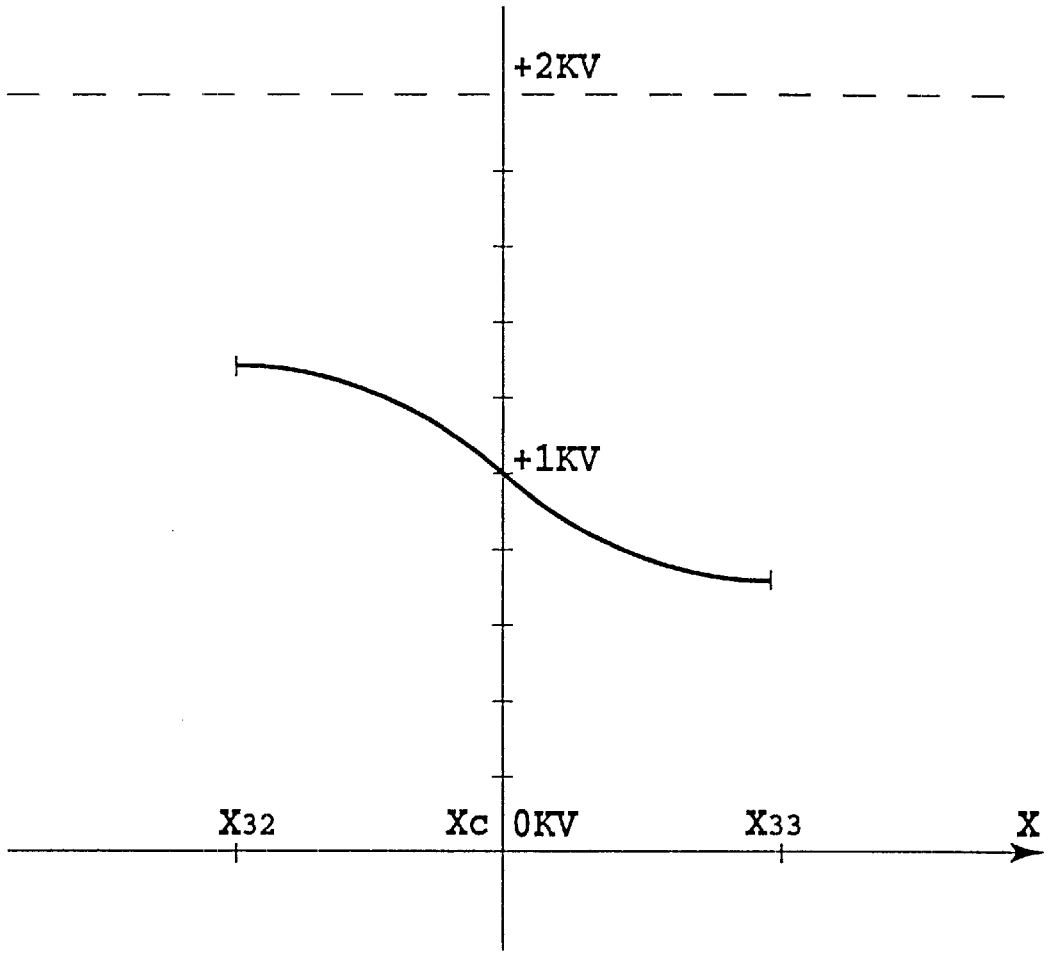
FIG. 20 is a graph showing a surface potential of the printing paper of the comparative example.

FIG. 20 shows the surface potential of the printing medium of the comparative example shown in FIG. 19. The surface potential of the printing sheet of the comparative is the maximum potential at an intermediate point $X_{32}$ of the electrode plate 32 and the value thereof is about 1.3 kV. On the other hand, at the center point Vc between the electrodes 32 and 33, the voltage becomes substantially 1 kV, and at the intermediate point $X_{33}$ of the electrode plate 33, the voltage becomes about 0.7 kV.

Comparing the embodiment shown in FIG. 17 and the comparative example of FIG. 19, the absolute value of the electric field on the printing sheet P is 0.3 kV at the maximum in the embodiment of FIG. 17, whereas in the comparative example, the absolute value of the electric field becomes 1.3 kV.

Figure 21:
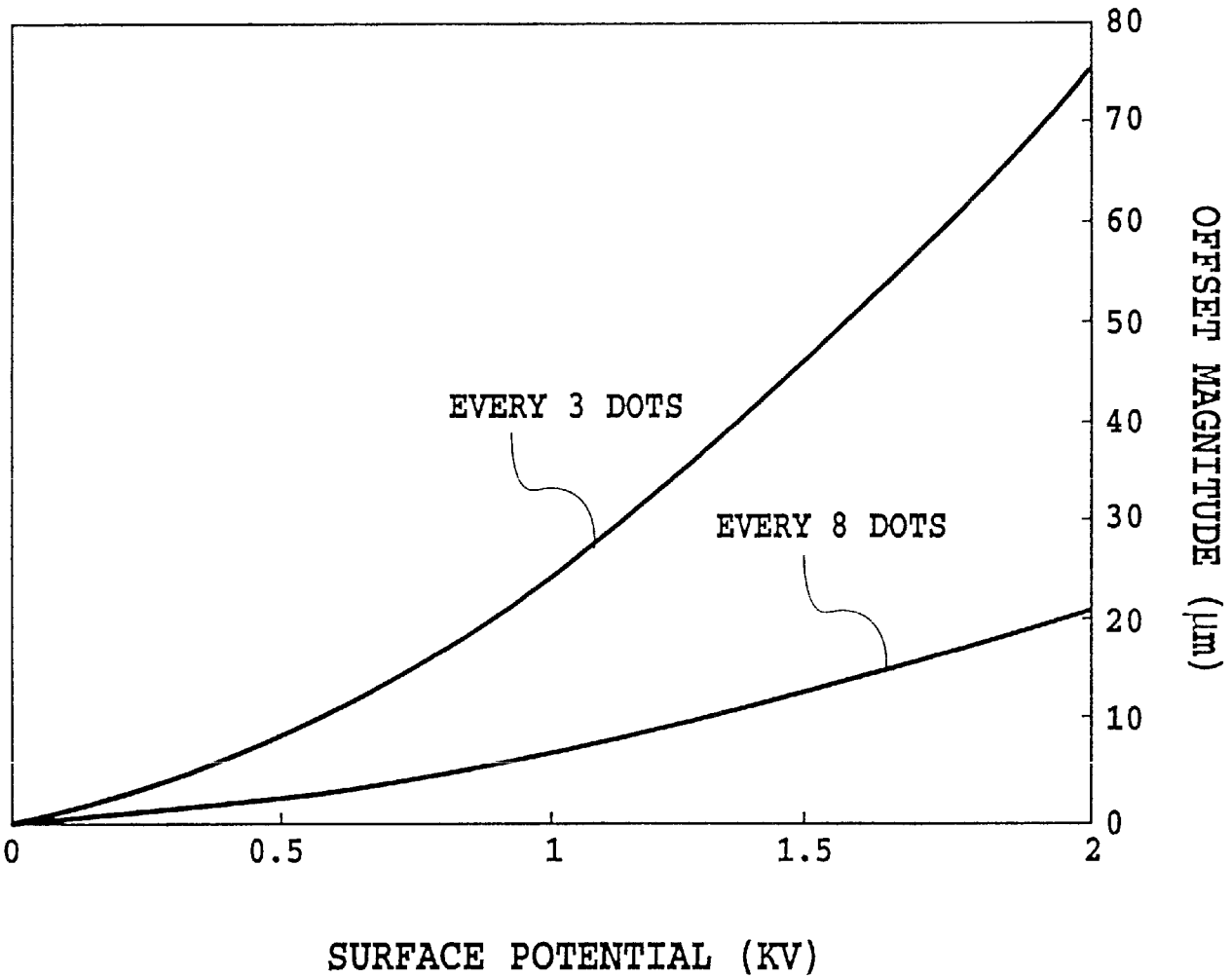
FIG. 21 is a graph showing the surface potential and offset amount.

FIG. 21 shows an offset of the depositing position of the ink droplet due to the electric field on the printing head and the printing sheet P. In FIG. 21, there are shown a graph of an offset of adjacent ink droplets of every three dots (127 $\mu$m interval) at 600 dpi and a graph of offset per every eight dots (340 $\mu$m interval). As can be seen from FIG. 21, when ink is ejected at every three dots by shifting ejection timing for avoiding simultaneous ejection of adjacent nozzles, offset becomes about 4 $\mu$m at the maximum potential 0.3 kV in the present invention. In contrast to this, in case of the comparative example, the offset becomes about 40 $\mu$m at the maximum potential 1.3 kV.

On the other hand, even when ink ejection is performed per every eight dots, the offset is merely about 1 $\mu$m in the present invention, whereas the offset becomes about 10 $\mu$m in the comparative example.

As set forth above, according to the present invention, upon suction with the same suction force, the present invention can restrict offset of the depositing position of the ink droplets significantly.

While the shown embodiment applies ±1 kV, it is desirable to lower the voltage to be applied, such as about, ±0.5 kV, in order to restrict offset of the depositing position. However, when the applied voltage is lower than ±1 kV, the suction force becomes too small to possibly cause floating of the printing medium. On the other hand, in order to make the suction force large, about ±3 kV of voltage may be applied. However, as set forth above, application of higher voltage causes greater magnitude of offset in the depositing position. Even in this case, offset of the depositing position is much smaller than that caused in the prior art.

Figure 22:
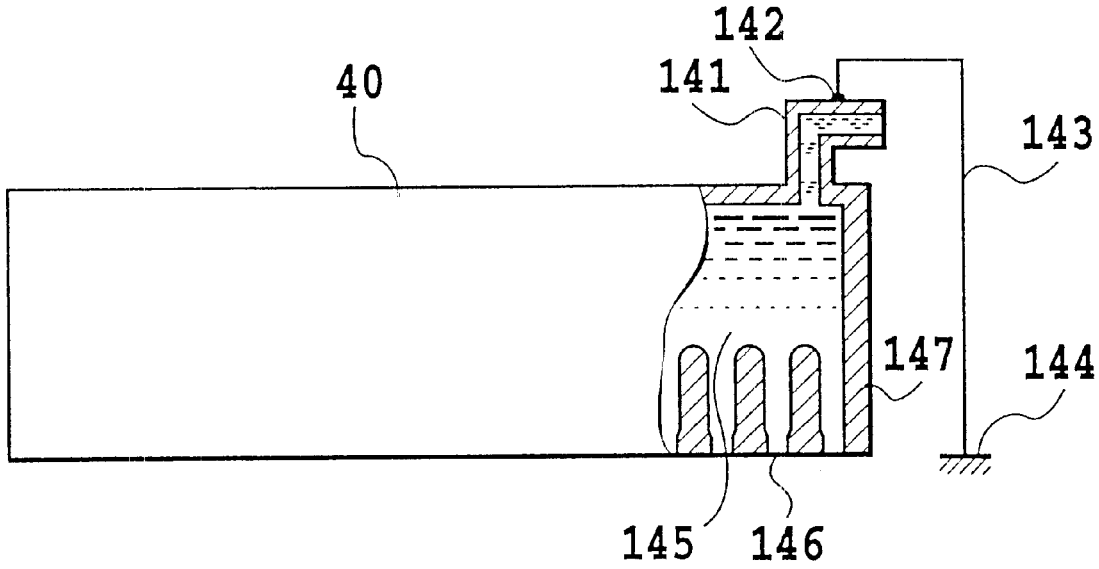
FIG. 22 is a diagrammatic section showing a grounding method of the printing head.

FIG. 22 shows a grounding means in the printing head 40. An ink joint portion 141 of the printing head 40 is formed with a stainless steel. A terminal 142 provided in the ink joint portion 141 is grounded to the main body frame 144 in the printing apparatus through a wire 143. Since the ink 145 is water soluble, an orifice portion 146 is also grounded to 0V through the ink.

In the alternative, when a base 147 of the printing head 40 is made of metal, the base 147 may be directly grounded to 0V to directly ground the orifice portion not through the ink.

As an alternative embodiment of the present invention, it is considered to provide a stationary electrode plate which has the electrode on the surface, below the transporting belt to suck the printing paper through the belt, to drive only belt for transporting the printing paper according to travel of the belt. In this case, a friction between the belt and the suction means may cause some problem, the construction of the belt per se can be simplified.

As a further alternative embodiment, it can be considered to provide a comb-shaped electrode on a surface of a rotary drum to suck the printing sheet on the surface of the rotary drum to transport the latter according to rotation of the rotary drum. In this case, in view of the layout of the overall apparatus, down-sizing becomes difficult. However, stability in transporting speed and transporting direction can be easily obtained.

It should be noted that while the shown embodiment has been explained for the case of ejection of the water soluble ink, the present invention is also effective for prevention of degradation of precision of the depositing position of the oil base ink due to polarization.

On the other hand, even in flying of powder instead of the liquid state ink, the present invention is applicable as long as the coloring material may cause polarization by the electric field.

Also, the coloring material may be colored material or material developing color in certain means.

With the embodiments as set forth above, when the suction mechanism using the electrostatic force and the ink-jet are combined, even if the high voltage is applied to the suction mechanism in order to generate sufficient suction force for avoiding contact between the printing medium and the printing head, disturbance of flying of the adjacent ink droplet may not be caused to make offset of the depositing position of the ink droplet quite small. Particularly, even when high density printing at a resolution higher than or equal to 600 dpi is to be performed with the full-line type printing head, in which a plurality of printing elements are aligned over the entire width of the printing sheet, offset of the depositing position of the ink droplets can be successfully restricted. The present invention is further effective at higher printing density, such as 1200 dpi, 2400 dpi.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing printing using a liquid ejection head ejecting a printing liquid, comprising:

a carrying surface for carrying a printing medium while supporting the printing medium in a region opposed to an ejection opening of said liquid ejection head;

an attraction force generating device for generating an attraction force that attracts said printing medium on said carrying surface; and a controlling section for controlling said attraction force generating device in order to create a plurality of regions where said attraction force is generated and where said attraction force is not generated in a predetermined region of said carrying surface in accordance with an ejection signal supplied to said liquid ejection head.

2. A printing apparatus as claimed in claim 1, wherein said attraction force generating device has a plurality of regions where said attraction force is generated, the plurality of regions being divided in a carrying direction of said carrying surface, and wherein said controlling section independently controls each of said plurality of divided regions to create regions where said attraction force is generated and where said attraction force is not generated in a predetermined region of said carrying surface.

3. A printing apparatus as claimed in claim 1, wherein said region where attraction force is generated is a region, and an area near the region, where printing is carried out on said printing medium by said liquid ejection head.

4. A printing apparatus as claimed in claim 1, which further comprises a depressing device for depressing said printing medium toward said carrying surface at a most upstream position of said region where the attraction force can be generated by said attraction force generating device.

5. A printing apparatus as claimed in claim 1, wherein said controlling section applies a positive and a negative high electric potential to said attraction force generating device with reference to an electric potential of said liquid ejection head.

6. A printing apparatus as claimed in claim 1, wherein said liquid election head has a plurality of printing elements arranged over the entire width of said printing medium.

7. A printing apparatus as claimed in claim 1, wherein said liquid ejection head is detachably mounted on a carriage which is reciprocally movable in a direction perpendicular to a carrying direction of said carrying surface.

8. A printing apparatus as claimed in claim 1, wherein said liquid ejection head has a thermal energy generating body applying thermal energy as sufficient energy for ejecting said printing liquid, in a liquid passage communicated with said ejection opening.

9. A printing apparatus as claimed in claim 8, wherein said thermal energy generating body is an electrothermal transducer causing a film boiling in said printing liquid.

10. A printing apparatus as claimed in claim 1, wherein said printing liquid is black, cyan, magenta and yellow inks, and wherein a plurality of said liquid ejection heads are arranged along the carrying direction of said carrying surface with respect to each ink.

11. A printing apparatus performing printing using a liquid ejection head ejecting a printing liquid, comprising:

a carrying surface for carrying a printing medium while supporting the printing medium in a region opposed to an ejection opening of said liquid ejection head;

an attraction force generating device for generating an attraction force for attracting said printing medium on said carrying surface; and a controlling section for controlling said attraction force generating device so as to create a plurality of regions where said attraction force is generated and where said attraction force is not generated in a predetermined region of said carrying surface opposed to said liquid ejection head.

12. A printing apparatus as claimed in claim 11, wherein said attraction force generating device has a plurality of regions where said attraction force is generated, said plurality of regions being divided in a carrying direction of said carrying surface, and wherein said controlling section independently controls each of said plurality of regions where attraction forces are generated to create regions where said attraction force is generated and where said attraction force is not generated in a predetermined region of said carrying surface.

13. A printing apparatus as claimed in claim 11, wherein said region where said attraction force is generated is a region, and an area near the region, where printing is carried out on said printing medium by said liquid election head.

14. A printing apparatus as claimed in claim 11, which further comprises a depressing device for depressing said printing medium toward said carrying surface at a most upstream position of said region where said attraction force can be generated by said attraction force generating device.

15. A printing apparatus as claimed in claim 11, wherein said controlling section applies a positive and a negative high electric potential with reference to an electric potential of said liquid election head.

16. A printing apparatus as claimed in claim 11, wherein said liquid ejection head has a plurality of printing elements arranged over the entire width of said printing medium.

17. A printing apparatus as claimed in claim 11, wherein said liquid ejection head is detachably mounted on a carriage which is reciprocally movable in a direction perpendicular to the carrying direction of said carrying surface.

18. A printing apparatus as claimed in claim 11, wherein said liquid ejection head has a thermal energy generating body applying thermal energy as sufficient energy for ejecting said printing liquid, in a liquid passage communicated with an ejection opening.

19. A printing apparatus as claimed in claim 18, wherein said thermal energy generating body is an electrothermal transducer causing a film boiling of said printing liquid.

20. A printing apparatus as claimed in claim 11, wherein said printing liquid is black, cyan, magenta and yellow inks, and wherein a plurality of said liquid ejection heads are arranged along a carrying direction of said carrying surface with respect to each ink.

21. A printing apparatus for performing printing using a liquid ejection head ejecting a printing liquid, comprising:

a carrying surface for carrying a printing medium while supporting the printing medium in a region opposed to an ejection opening of said liquid ejection head;

an attraction force generating device for generating an attraction force that attracts said printing medium on said carrying surface; and a controlling section for controlling said attraction force generating device so as to create a plurality of regions where said attraction force is generated and where said attraction force is not generated in a predetermined region of said carrying surface opposite to said liquid ejection head in accordance with plural ejection signals supplied to said liquid ejection head.

22. A printing apparatus as claimed in claim 21, wherein said attraction force generating device has a plurality of regions where the attraction force can be generated, said plurality of regions being divided in a carrying direction of said carrying surface, and wherein said controlling section independently controls each of said plurality of divided regions where said attraction forces are generated to create plural regions where said attraction force is generated and where said attraction force is not generated in a predetermined region of said carrying surface.

23. A printing apparatus as claimed in claim 21, wherein said region where said attraction force is generated is a region, and an area near the region, where printing is carried out on said printing medium by said liquid ejection head.

24. A printing apparatus as claimed in claim 21, which further comprises a depressing device for depressing said printing medium toward said carrying surface at a most upstream position of said region where the attraction force can be generated by said attraction force generating device.

25. A printing apparatus as claimed in claim 21, wherein said controlling section applies a positive and a negative high electric potential to said attraction force generating device with reference to an electric potential of said liquid ejection head.

26. A printing apparatus as claimed in claim 21, wherein said liquid ejection head has a plurality of printing elements arranged over the entire width of said printing medium.

27. A printing apparatus as claimed in claim 21, wherein said liquid ejection head is detachably mounted on a carriage which is reciprocally movable in a direction perpendicular to a carrying direction of said printing medium.

28. A printing apparatus as claimed in claim 21, wherein said liquid ejection head has a thermal energy generating body applying thermal energy as sufficient energy for ejecting said printing liquid, in a liquid passage communicated with said ejection opening.

29. A printing apparatus as claimed in claim 28, wherein said thermal energy generating body is an electrothermal transducer causing a film boiling of said printing liquid.

30. A printing apparatus as claimed in claim 21, wherein said printing liquid is black, cyan, magenta and yellow inks, and wherein a plurality of said liquid ejection heads are arranged along a carrying direction of said carrying surface with respect to each ink.

31. A printing method for performing printing using a liquid ejection head for ejecting printing liquid, comprising steps of:

supporting and carrying a printing medium to a region opposed to an ejection opening of said liquid ejection head by a carrying surface;

generating an attraction force for attracting said printing medium on said carrying surface; and creating a plurality of regions where said attraction force is generated and where said attraction force is not generated in a predetermined region of said carrying surface in accordance with plural ejection signals supplied to said liquid ejection head.

32. A printing method as claimed in claim 31, wherein a plurality of regions where said attraction force is generated is provided, said plurality of regions being divided in a carrying direction of said carrying surface, and wherein each of said plurality of divided regions where said attraction forces are generated is independently controlled to create regions where said attraction force is generated and where said attraction force is not generated in a predetermined region of said carrying surface.

33. A printing method as claimed in claim 31, wherein said region where said attraction force is generated is a region, and an area near the region, where printing is carried out on said printing medium by said liquid ejection head.

34. A printing method for performing printing using a liquid ejection head for ejecting printing liquid, comprising steps of:

supporting and carrying a printing medium in a region opposed to an ejection opening of said liquid ejection head by a carrying surface;

generating an attraction force for attracting said printing medium on said carrying surface; and creating a plurality of regions where said attraction force is generated and where said attraction force is not generated in a predetermined region of said carrying surface opposed to said liquid ejection head.

35. A printing method as claimed in claim 34, wherein a plurality of regions where said attraction force is generated is provided, said plurality of regions being divided in a carrying direction of said carrying surface, and each of said plurality of divided regions is independently controlled to create a plurality of regions where said attraction force is generated and where said attraction force is not generated in a predetermined region of said carrying surface.

36. A printing method as claimed in claim 34, wherein said region where said attraction force is generated is a region, and an area near the region, where printing is carried out on said printing medium by said liquid ejection head.

37. A printing method for performing printing using a liquid ejection head for ejecting printing liquid, comprising steps of:

supporting and carrying a printing medium in a region opposed to an ejection opening of said liquid ejection head by a carrying surface;

generating an attraction force for attracting said printing medium on said carrying surface; and creating a plurality of regions where said attraction force is generated and where said attraction force is not generated in a predetermined region of said carrying surface opposed to said liquid ejection head in accordance with plural ejection signals supplied to said liquid ejection head.

38. A printing method as claimed in claim 37, wherein a plurality of regions where said attraction force is generated is provided, said plurality of regions being divided in a carrying direction of said carrying surface, and wherein each of said plurality of divided regions where said attraction force is generated is independently controlled to create a plurality of regions where said attraction force is generated and where said attraction force is not generated in a predetermined region of said carrying surface.

39. A printing method as claimed in claim 37, wherein said region where said attraction force is generated is a region, and an area near the region, where printing is carried out on said printing medium by said liquid ejection head.

* * * * *

UNITED STATES PATENT AND TRADEMARK OFFICE

CERTIFICATE OF CORRECTION

PATENT NO. : 6,511,172 B2
DATED : January 28, 2003
INVENTOR(S) : Tanno et al.

It is certified that error appears in the above-identified patent and that said Letters Patent is hereby corrected as shown below:

Column 1,
Line 34, “such” should read -- such a --; and
Line 63, “view” should read -- views --.

Column 3,
Line 50, “with” should be deleted.

Column 4,
Line 19, “arranged” should read -- arranged with --;
Line 38, “line a—a” should read -- line IIIB - IIIB --; and
Line 52, “line a—a” should read -- line VIIIB - VIIIB --.

Column 5,
Line 8, “line a—a” should read -- line XIVB - XIVB --; and
Line 9, “line b—b” should read -- line VIIIB - VIIIB --.

Column 6,
Line 31, “end” should read -- end of --.

Column 8,
Line 43, “is” should read -- does --.

Column 10,
Line 14, “the.” should read -- the --.

Column 11,
Line 56, “is” should be deleted.

Column 12,
Line 38, “line a—a” should read -- line XIVB - XIVB --.

Column 13,
Line 27, “distance” should read -- distance between --.

UNITED STATES PATENT AND TRADEMARK OFFICE

CERTIFICATE OF CORRECTION

PATENT NO. : 6,511,172 B2
DATED : January 28, 2003
INVENTOR(S) : Tanno et al.

It is certified that error appears in the above-identified patent and that said Letters Patent is hereby corrected as shown below:

Column 16,
Line 26, “consists” should read -- consist --.

Column 18,
Lines 5, 51 and 60, “election” should read -- ejection --; and
Line 43, “regions” should read -- divided regions --.

Signed and Sealed this

Sixteenth Day of March, 2004

JON W. DUDAS
*Acting Director of the United States Patent and Trademark Office*